US005645279A

United States Patent [19]

Reutlinger

[11] Patent Number: 5,645,279

[45] Date of Patent: Jul. 8, 1997

[54] VEHICLE HISTORY AND TRIVIA RACE GAME

[76] Inventor: Alicia L. Reutlinger, 3509 Hycliffe Ave., Louisville, Ky. 40207

[21] Appl. No.: 650,321

[22] Filed: May 20, 1996

[51] Int. Cl.[6] ..... A63F 3/00

[52] U.S. Cl. ..... 273/249; 273/430

[58] Field of Search ..... 273/243, 248, 273/249, 251, 254, 429, 430, 431

[56] References Cited

U.S. PATENT DOCUMENTS

| | | | |
|---|---|---|---|
| 2,163,011 | 6/1939 | Schaub . | |
| 4,109,917 | 8/1978 | Hatcher . | |
| 4,426,084 | 1/1984 | Michel . | |
| 4,624,463 | 11/1986 | Glennon . | |
| 4,887,818 | 12/1989 | Escott . | |
| 5,066,016 | 11/1991 | O'Neill | 273/249 |
| 5,139,267 | 8/1992 | Trevisan . | |
| 5,167,503 | 12/1992 | Jordan | 273/249 X |
| 5,261,671 | 11/1993 | Wyatt | 273/249 |
| 5,282,630 | 2/1994 | Dupuis, Jr. . | |
| 5,511,792 | 4/1996 | Simmons et al. | 273/249 X |
| 5,516,111 | 5/1996 | Strickland, Jr. | 273/430 X |

FOREIGN PATENT DOCUMENTS 2272838 6/1994 United Kingdom .

*Primary Examiner*—William E. Stoll

*Attorney, Agent, or Firm*—Middleton & Reutlinger; David W. Carrithers

[57] ABSTRACT

This invention provides a simulated race board game for both amusement and education which includes playing pieces which are replicas of motorized vehicles, such as automobiles or motorcycles. The present invention relates to a board game of questions related to the past, present, and potential future of a particular vehicle. It is a game to challenge the knowledge of and educate persons interested in the history of a particular vehicle played with cards having trivia questions and answers.

20 Claims, 5 Drawing Sheets

DEAD END
W
B
G
B
DETOUR
W
EXPRESS
W
E
G
X
B
P
G
R
W
E
B
S
G
S
B
VEHICLE STOLEN
R
G
LOGO 4
B
G
B
W
B
G
B
G
B
G

New Battery $ 50

28

FIG. 5

In what year was a new racing type rear view mirror standard?

a) 1967
b) 1968
c) 1969

30

FIG. 6

| START $1,700 | BALANCE 1,200 | BALANCE 475 | BALANCE |
|---|---|---|---|
| -300 | 50 | 200 | |
| 1,400 | 1,250 | 675 | |
| -200 | -1,000 | -100 | |
| 1,200 | 250 | 575 | |
| 500 | 200 | | |
| 1,700 | 450 | | |
| -100 | 50 | | |
| 1,600 | 500 | | |
| -400 | -25 | | |
| 1,200 | 475 | | |

24

FIG. 7

VEHICLE HISTORY AND TRIVIA RACE GAME

BACKGROUND OF THE INVENTION

The present invention relates to a method of playing a competitive race board game involving two or more players requiring historical knowledge for a particular vehicle, and utilizing a game board, cards, die, and game pieces. This invention provides a simulated race for both amusement and education which includes playing pieces which are replicas of a motorized vehicle.

Board games for racing are well known; however, the board game of the present invention utilizes strategy and historical knowledge for particular vehicles. In view of the increasing popularity of famous cars, trucks, and motorcycles, a board game with a historical theme relating to a particular vehicle is desirable as an entertainment and educational tool for children and automotive enthusiasts as well.

The present invention relates to a board game of questions related to the past, present, and potential future of a particular vehicle. It is a game to challenge the knowledge of and educate persons interested in the history of a particular vehicle. Vehicle enthusiasts, as well as other persons knowledgeable about the vehicle and racing industries, are well aware of the history and importance of certain historical vehicles manufactured in the United States and throughout the world. Many clubs have been formed so that owners and admirers of these vehicles may exchange valuable information about their vehicles and present their vehicles to the public for viewing. Certain models are so rare that the only way to view these vehicles is through the cooperation of these clubs. This game will assist both vehicle owners, enthusiasts, and even the general public in the transfer of knowledge and education.

SUMMARY OF THE INVENTION

This invention provides a simulated race board game for both amusement and education which includes playing pieces which are replicas of motorized vehicles, such as automobiles or motorcycles. The present invention relates to a board game of questions related to the past, present, and potential future of a particular vehicle. It is a game to challenge the knowledge of and educate persons interested in the history of a particular vehicle played with cards having trivia questions and answers.

More particularly, the present invention is a vehicle history and trivia game including a game board having a course layout which includes a symbol selected from the group consisting of a name, letter, or acronym of a particular vehicle; a set of draw cards; a set of trivia cards; a set of playing pieces depicting vehicles having specifications and features described by the trivia cards; and means of advancing the playing pieces along the course according to chance.

The game of the present invention is played by rolling one die on or near a game board having designated spaces and moving a game piece along a designated course. The main object of this game is to be the first player to maneuver their game piece to the endpoint of the game indicated on the game board. To accomplish this a player is given a predetermined amount of money. Throughout the game, chance determined events may cause a player to utilize a predetermined amount of funds to correct a problem which has befallen their vehicle. These problems have been chosen to represent typical occurrences associated with the extended ownership and usage of a vehicle. The player must complete the course without running out of money. The spaces along the course on the game board are color coded. When a player lands on one of the color coded spaces, the player will be required to either answer corresponding color coded cards requiring the player to respond to a vehicle history trivia question, to pay a penalty, or to be accessed a reward. Should a trivia question be asked, a correct response would warrant another roll of the die, and play would continue on for that player. If a player spends all of the allotted money before reaching the destination, the player is disqualified.

The players take turns rolling at least one die on or near the game board, and move the game piece along the course. Should a trivia question be asked, a correct response would warrant another roll of the die, and play would continue on for that player. The first player to maneuver their game piece to the endpoint of the game indicated on the game board wins the game. To accomplish this a player must complete the course without running out of money due to reparations, and they must avoid a space "Vehicle Stolen".

Accordingly, it is a principal object of the present invention to provide a board game utilizing game pieces representative of different models of the same brand of vehicle.

It is another object of the present invention to provide a board game having a course layout which includes and/or depicts a symbol selected from a name, letter, or acronym of a particular model or brand name of a selected vehicle.

It is another object of the present invention to provide a board game utilizing historical data and specifications for particular vehicles.

Finally, it is yet another object of the present invention to provide a board game whereby the players experience the costs and pitfalls associated with owning a vehicle.

BRIEF DESCRIPTION OF THE DRAWINGS

A better understanding of the present invention will be had upon reference to the following description in conjunction with the accompanying drawings in which like numerals refer to like parts throughout the several views and wherein:

FIG. 5 is a plan view of a "Draw Card" employed in the present invention;

FIG. 6 is a plan view of a "Trivia Card" employed in the present invention; and FIG. 7 is a plan view of a Scorecard employed in the present invention.

SPECIFICATION

The Vehicle History and Trivia Race Game is for two to four players having recommended ages of ten and above. The objective of the game is to be the first player to reach the endpoint on the game board.

The components of the Vehicle History and Trivia Race Game of the present invention is manufactured from readily available materials and simple in design. The game board may be composed of fiberboard, wood, paper, or plastic. The game pieces may be comprised of metal, wood, or plastic and may be immovable replica models of existing vehicles, or mobile toy replicas of vehicles such as are currently sold under the trademark of HOTWHEELS®, MICRO MACHINES®, or other toy manufacturer which produces replicas of automobiles, planes, trains, ships, or motorcycles.

With reference now to FIGS. 1–7, there is shown an operative embodiment of the present invention.

Figure 1:
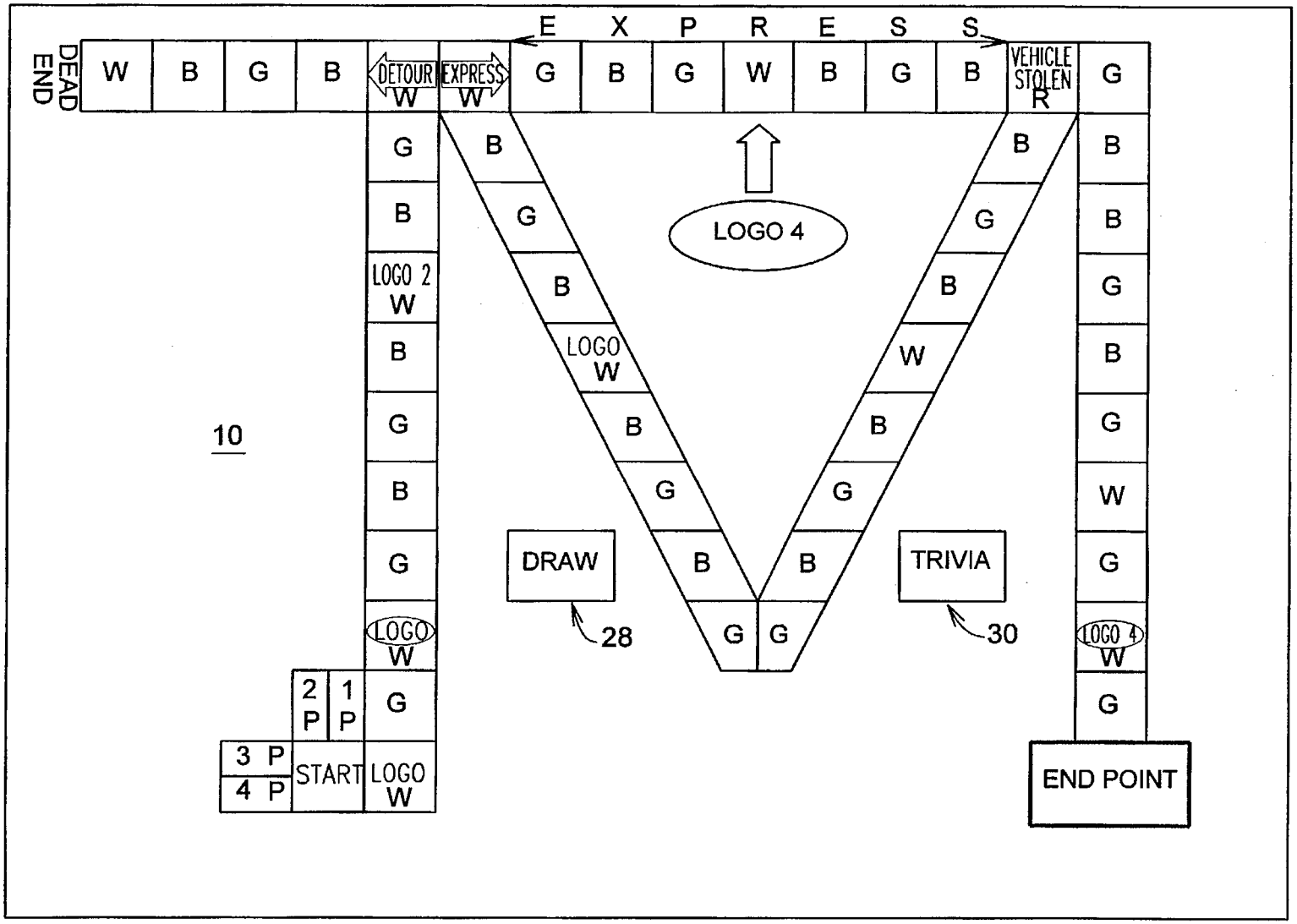
FIG. 1 is a top plan view of an embodiment of a vehicle history and trivia game board of the present invention.
Figure 2:
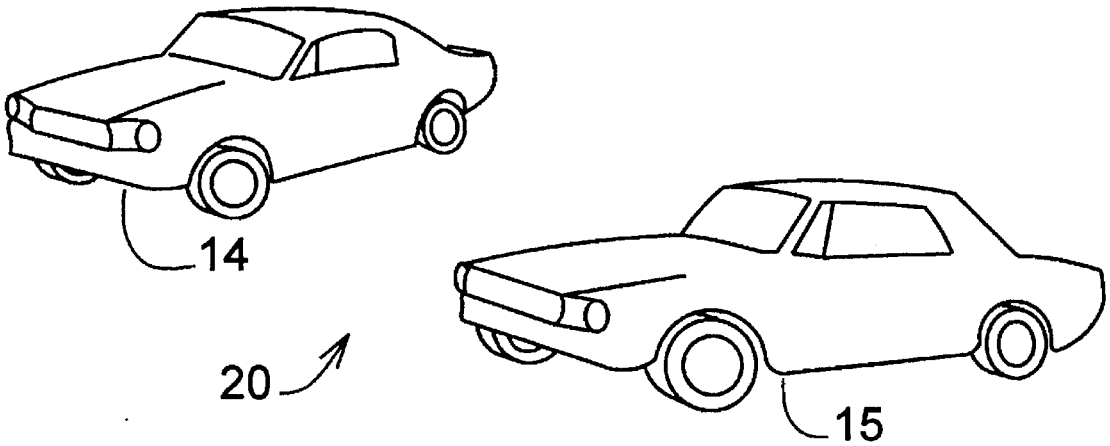
FIG. 2 is a perspective view of one embodiment of game pieces showing automobiles for use with the game board of FIG. 1.
Figure 3:
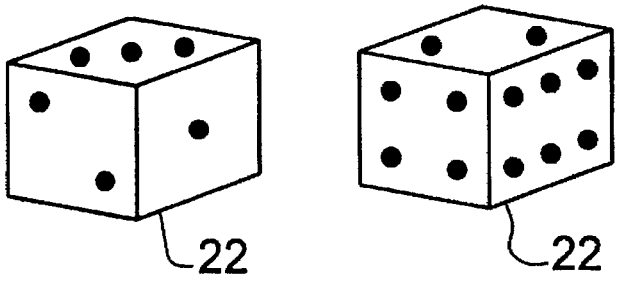
FIG. 3 is a perspective view of a pair of die for use in the present invention.

The present invention relates to a method of playing a competitive race game involving historical knowledge, and utilizing a game board 10 which has been designed a course layout which includes and/or depicts the name, letter, or acronym of a particular model or brand name of a selected vehicle. As shown in FIG. 1, the game board layout depicts the capital letter "M" such as might designate a famous automobile, for instance "MUSTANG®" produced by the FORD MOTOR COMPANY. The embodiment of FIG. 1 is layout in the shape of a capital letter, "M". The capital letter signifies the first letter of the proper name of the particular motorized vehicle.

This invention provides a simulated race for both amusement and education which includes at least two playing pieces, 14 and 15, and preferably four playing pieces, which are replicas of a motorized vehicle. Replicas 20 refers to the plurality of minature models of motorized vehicle playing pieces 14–15. These replica playing pieces 20 are to be constructed by a toy manufacturer, who would be licensed from the manufacturer of the actual vehicle at a reduced scale, preferably at 1/32nd scale or more preferably at 1/64th scale in size relative to the real vehicle. The replicas 20 would preferably be mobile, and would be repositioned on the game board 10 following chance determined events throughout the game, which simulates vehicle ownership. The replicas 20 may include any of the following types of vehicles: automobiles (i.e. FORD MUSTANG®, CHEVROLET CORVETTE®, DODGE CHARGER®, etc.); trucks (MACK®, etc.); motorcycles (i.e. HARLEY DAVIDSON®, etc.); tractors (OLIVER®, etc.); trains (i.e. PULLMAN®, AMTRACK®, etc.); ships (OLD IRONSIDES®, etc.); tanks (PATTON®, etc.); and aircraft (BOEING®, McDONNEL DOUGLAS®, including historical military aircraft etc.). Each of the replicas 20 are differentiable one from another, either by color or style. In the preferred embodiment, the individual game pieces 14–15 comprising the replicas 20, would consist of different styles or model years of the same vehicle, especially when utilizing vehicles defining automobiles. However, it is contemplated that different models of replicas would be used where the classes of replicas are limited such as with tanks or airplanes. Additionally, new and different die-cast vehicle game pieces may be added or supplied for the game as manufacturer's introduce new models into the market place.

Figure 4:
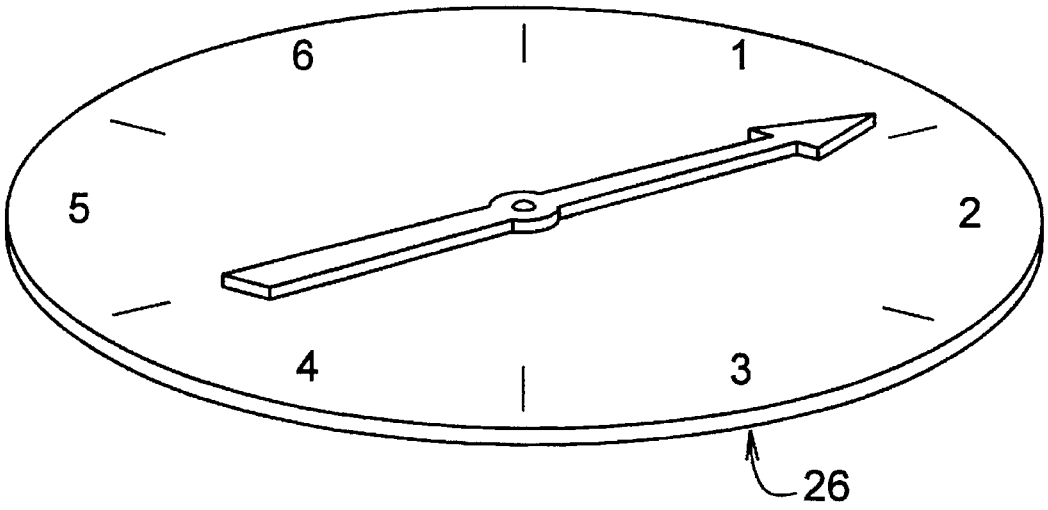
FIG. 4 is a perspective view of a dial or spinner for use in the present invention.

To begin the game each player receives a replica 20 (14–15), at least one die 22, and a scorecard 24 as shown in FIGS. 10–7. It is contemplated that the players may share the die 22 or substitute a spinner 26 such as shown in FIG. 4. The player to take the first turn and select the desired replicas 20 is determined by rolling the die 22 and obtains the highest or lowest score as decided by the players before the die 22 is thrown. Ordinarily, in the preferred embodiment the player who rolls the highest number gains the number 1 starting position on the board. In order to describe the game, the following examples will utilize four players. Moving clockwise from the starting player, the remaining starting positions are assigned subsequent numbers 2, 3, and 4. The player's replicas 20 are positioned in the parking spaces designated by "P" adjacent the "START" space.

In the embodiment depicted in FIG. 1, the game provides a course in the general shape of an "M" 12 having fifty-two (52) spaces of various selected colors.

The player who wins the number one starting position rolls at least one die to start the game. Each player 1–4 in turn will roll the die 22, travel the number of spaces, which represent miles or kilometers, according to the roll, and follow any instructions of the space that the player lands upon. For instance, one space equals one mile (kilometer), two spaces equals two miles (kilometers), and so on. The first player 1 to enter the endpoint space on the game board 10 is the winner. In the preferred embodiment, a player 1–4 must roll the exact number of miles needed, including the endpoint space in order to win.

Each player begins the game with a predetermined amount of cash or credit, for instance, $1700.00 to use for vehicle costs associated with playing the game. Each player 1–4 is given a scorecard 24 used to track the running total for each player's funds. Expense items, such as repair bills, or cash awards, are indicated through drawing cards of chance. The monetary gains or losses associated with these items are recorded in the spaces of the scorecard 24. The running totals are recorded in the alternate spaces of the scorecard 24. If a player's running total is less than ZERO, they are disqualified from playing and are out of the game.

The game board 10 embodiment shown in FIG. 1 includes fifty-two (52) spaces on the board. The board spaces 26 are color coordinated with one or more particular types of cards. For instance, the embodiment portrayed in FIG. 1 shows nineteen (19) green spaces designated by the letter "G"; twenty (20) blue spaces designated with the letter "B"; one (1) red space designated with the letter "R"; eleven (11) white spaces designated with the letter "W"; and one (1) finish space designated as the "END POINT". When a player lands on one of the nineteen (19) green colored spaces "G", the player will select a Draw card 28 which are color coordinated green, read the text on the Draw card 28 to the other players, and follow the instructions. When a player lands on one of the twenty (20) blue colored spaces "B", the player to the moving player's left will select a Trivia card 30 which are color coordinated blue and read the question to the player on the blue space "B". Additional Trivia card 30 packs may be supplied to keep the questions up to date, and to continue to document the progress of the vehicle as new models are introduced by the manufacturer.

In the preferred embodiment, the questions (multiple choice, true/false, matching, yes/no, or short answer), and the answer are printed on the face of the blue trivia cards 30 as shown in FIG. 6. The non-moving player who selects the trivia card(s) 30 must read the question and tell the moving player whether they have answered correctly. The moving player will attempt to answer the question correctly. A correct response would warrant another roll of the die 22, and play would continue on for that player. It is contemplated that the green and blue colors indicated for the Draw and Trivia cards listed above are only used as examples, and may be substituted by any other color combination in an alternative embodiment; however, the cards are preferably color coordinated to match the board spaces 26.

Each Vehicle History and Trivia Race Game contains a specified number of Draw cards 28. At the beginning of the game, the Draw cards 28 are placed on a corresponding colored box "square defining a designated position", for instance a green colored box in the "M" game board labeled "DRAW".

The Draw cards 28 include a limited number of "Repair Cards", as shown in FIG. 5, which include may describe various bills which are recorded as negative amounts on the scorecard 24. In the preferred embodiment, a limited number of model year specific cards for repair may also be used. These model year specific cards would apply only to the player driving that particular year vehicle. Throughout the game, chance determined events may cause a player to utilize a predetermined amount of funds to correct a problem which has befallen their vehicle. These problems have been chosen to represent typical occurrences associated with the extended ownership and usage of a vehicle.

The Draw cards 28 also include a limited number of "Coupon Cards". The coupon cards may be used to offset repair costs. It is contemplated that the players have the option to buy or sell coupons from other players; however, this option would have to be declared before the start of the game. Upon selection of a coupon card by a player landing on a green Draw card space "G", it should be placed face up in front of the player and the next player takes a turn. When a repair card that matches a coupon card previously selected and held by a player is selected, the two cards are placed beside the player, and a net amount (if any) is recorded on the scorecard and the next player takes a turn. However, coupon cards cannot be used to reduce or offset repair costs paid from a prior turn. For example, upon selection of a coupon card stating "battery half price" and subsequent selection of a Repair card "battery, cost $50.00", the resulting loss of –$25.00 is recorded on the scorecard 24. As another example, upon selection of a coupon card "Free oil change" and subsequent selection of a Repair card "Oil change, cost $25.00", no amount is recorded on the scorecard 24.

The Draw cards 28 include a limited number of "Directional Cards". The Directional cards instruct a player to "go ahead" or "go back" a certain number of miles. A player's turn is over once they have moved the specified number of miles.

The Draw cards 28 include a limited number of "Lose A Turn Cards". Upon selecting a Lose a Turn card, the player loses their next, and resumes play after the other players have taken their turn.

The Draw cards 28 include a limited number of "Special Instruction Cards". The Special Instruction cards require a player to trade positions and replicas 20 with any other player 1–4 on the board 10. Players do not trade scorecards. A player must trade positions and replicas 20 with another player, even if they are presently in the lead.

All of the Draw cards 28 which include coupon cards, repair cards, directional cards, lose a turn cards, and special instruction cards are shuffled and mixed randomly together before starting the game.

A list of the preferred Draw cards 28 for the "M" using for example a FORD® MUSTANG® are as follows:

| | |
|---|---|
| *** 1965 *** | *** 1978 *** |
| Set Of 4 Red Line Tires | Front & Rear Bumpers |
| $250 | $225 |
| *** 1965 *** | *** 1982 *** |
| Woodgrain Steering Wheel | Front & Rear Sway Bars |
| $100 | $250 |
| *** 1965 *** | *** 1982 *** |
| New Dash Pad | New Interior Carpet |
| $150 | $125 |
| *** 1978 *** | *** 1982 *** |
| Complete Center Console w/coin tray and shifter plate | Aluminum Window Louvers |
| $175 | $125 |

-continued

| | |
|---|---|
| *** 1978 *** | *** 1994 *** |
| Grill W/ Horse Included | Set Of 4 Performance Tires |
| $100 | 1 Of 2 Installment Payments |
| | $250 |
| *** 1994 *** | Need Gasoline |
| Set Of 4 Performance Tires | $10 |
| 1 Of 2 Installment Payments | |
| $250 | |
| New Battery | Need Gasoline |
| $50 | $10 |
| Tow Bill Due To Breakdown | Need Gasoline |
| $25 | $10 |
| Custom Car Cover | Need Gasoline |
| $100 | $10 |
| Custom Floor Mats | Go To Ford Dealership |
| $50 | To Buy A Radiator |
| | $125 |
| Go To Ford Dealership | Subscription To A |
| To Buy A Waterpump | Mustang Magazine |
| $50 | $25 |
| Insurance Premium Due | New Transmission |
| $300 | $1,000 |
| Insurance Premium Due | Oil & Filter Change |
| $400 | $25 |
| Complete Exhaust System | Oil & Filter Change |
| $225 | $25 |
| Mustang Club Membership Dues | New Paint Job |
| $25 | $1,000 |
| Property Taxes Due | License Tag Renewal |
| On Your Mustang | $25 |
| $200 | |
| Property Taxes Due | Shock Absorbers |
| On Your Mustang | $100 |
| $300 | |
| Rebuilt Transmission | SPEEDING TICKET! |
| $500 | $100 |
| Rebuilt Engine | SPEEDING TICKET! |
| $900 | $100 |
| Remanufactured Engine | Windshield Wiper Refills |
| $1,500 | $10 |
| Mustang Featured In | A Friend Buys A New |
| TV Advertisement | Mustang From Ford |
| Receive $200 | You Receive $50 |
| Mustang Featured In | A Friend Buys A New |
| TV Advertisement | Mustang From Ford |
| Receive $200 | You Receive $50 |
| Win First Place | A Friend Buys A New |
| In Car Show | Mustang From Ford |
| $300 | You Receive $50 |
| Win First Place | A Friend Buys A New |
| In Car Show | Mustang From Ford |
| $300 | You Receive $50 |
| A Friend Buys A New | Win Second Place |
| Mustang From Ford | In Car Show |
| You Receive $50 | $200 |
| Win Second Place | Win Third Place |
| In Car Show | In Car Show |
| $200 | $100 |
| TAX REFUND! | Win Car Show |
| $1,000 | Cash Raffle |
| | $100 |
| TAX REFUND! | Win Car Show |
| $700 | Cash Rate |
| | $50 |
| TAX REFUND! | Win A ¼ Mile Race |
| $500 | Against A Friend |
| | $50 |
| Win Third Place | Win a ¼ Mile Race |
| In Car Show | Against A Friend |
| $100 | $50 |
| Go Ahead | Go Back |
| 1 Mile | 2 Miles |
| Go Ahead | Go Back |
| 2 Miles | 3 Miles |
| Go Ahead | Go Back |
| 3 Miles | 4 Miles |
| Go Ahead | Flat Tire |
| 4 Miles | LOSE A TURN |
| Go Back | Flat Tire |
| 1 Mile | LOSE A TURN |

-continued

| | |
|---|---|
| TRADE POSITIONS & CARS WITH PLAYER OF YOUR CHOICE | Free Gasoline |
| TRADE POSITIONS & CARS WITH PLAYER OF YOUR CHOICE | Free Gasoline |
| Battery Half Price | Free Gasoline |
| Rebuilt Or Remanufactured Engine Half Price | Free Gasoline |
| Rebuilt Or Remanufactured Engine Half Price | Free Oil & Filter Change |
| Free Oil & Filter Change | Complete Exhaust System Half Price |
| Free Oil & Filter Change | Complete Exhaust System Half Price |
| Free Oil & Filter Change | New Or Rebuilt Transmission Half Price |
| Shock Absorbers Half Price | New Or Rebuilt Transmission Half Price |
| Shock Absorbers Half Price | New Battery $50 |
| Battery Half Price | |
| Oil & Filter Change $25 | |
| Oil & Filter Change $25 | |

Each Vehicle History and Trivia Race Game contains a specified number of trivia cards 30. At the beginning of the game, the trivia cards 30 are placed on a corresponding colored box "square defining a designated position", for instance a blue colored box in the "M" game board 10 labeled "TRIVIA". The player to the left of the moving player that landed on a blue board space "B" reads the question to the moving player. If the player on board space "B" answers the question correctly, the moving player receives an extra turn. The moving player continues to receive an extra turn for each trivia question answered correctly after landing on a blue board space "B". When the moving player answers a trivia question incorrectly, the moving player's turn is over. There is no penalty for incorrect answers. If the player lands on any other type of space, they follow its instructions (if any) and then their turn is over.

It is contemplated that the trivia card 30 list will be updated periodically. A list of the preferred Trivia cards 30 for the "M" game shown in FIG. 1 using for example a FORD® MUSTANG® are as follows:

Which Ford Design Studio presented the clay model version that formed the basis for the production Mustang?
a) Corporate Projects
b) Ford Division
c) Lincoln Mercury b In 1964 Ford named their new car "Mustang" after the P-51 Mustang fighter, which is a veteran of which 2 wars?
a) World War II
b) Vietnam War
c) Korean War a c Only 6 weeks after its first public showing, the Mustang was selected to be the official pace car at what race?
Indianapolis 500

Where was the first production Mustang assembled on March 9, 1964?
a) Dearborn Assembly Plant
b) Shelby-American Los Angeles
c) Ford Plant in San Jose a The Mustang was the first automobile to be honored by Tiffany & Co. and received the Tiffany Award for Excellence in American Design.
True or False?
True In 1965 & 1966 a vinyl roof was offered as a factory option on the Hardtop in which 2 colored vinyls?
a) Black
b) Tan
c) White a c An attractive removable hardtop was dealer furnished for the 1965 & 1966 Mustang GT Convertible.
True or False?
True In what year was a special custom Mustang station wagon introduced in an appeal to suburban market, but with very limited success?
a) 1965
b) 1966
c) 1964½ a Which model has corner posts that are trimmed in bright metal?
a) Fastback
b) Convertible
c) Hardtop b When was the 1 millionth Mustang produced?
a) June 2, 1966
b) March 2, 1966 b
(less than 24 months after the car's introduction)

Is the 1965 grill ornament one piece?
Yes or No?
No

In 1964 a Hardtop Coupe and Convertible model were offered. Which model outsold the other by over 3 to 1?
Hardtop Coupe The Rally Pac was a typical 1965/66 accessory. Name the 2 instruments this Rally Pac included.
a) Clock
b) Tachometer
c) Temperature gauge a b The Day-Night mirror for 1966 has what type of adjustment?
a) Rocker-type
b) Turn-screw b In November 1964 an all metal pedal-operated Midget Mustang was offered as a promotional item at what price?
a) $17.99
b) $14.95
c) $12.95 c Which 2 of the following items are typical 1965/66 aftermarket accessories?
a) Lake pipes (side exhaust)
b) "Pony" hood ornament
c) "Pony" bumperettes b c The one piece cast "MUSTANG" on the fenders of a 65' are longer than they were on the 64½ models.
How long is the 65' emblem?
a) almost 5"
b) almost 6"
c) almost 7" a To operate the horn on the 1964½ Mustang, depress the hub of the steering wheel.
True or False?
False
(depress one of the buttons on the spokes of the steering wheel)

Disc brakes were an available option for the front wheels of 1965 Mustangs equipped with 8 cylinder engines.
True or False?
True The 3 Body Types for 1965 are Hardtop, Fastback, and Convertible. For a correct answer match any 1 Body Type to its correct Body Style Code.
a) 63A → Fastback
b) 65A → Hardtop
c) 76A → Convertible Which one of the 3 choices is not standard equipment on a 1965 Mustang?
a) Heater-defroster
b) Cigarette lighter
c) Two-speed electric wipers c The horizontal speedometer scale initially adapted from the Falcon unit was replaced in the spring of what year with a new five dial instrument panel that appeared with the new GT option?
a) 1965
b) 1966
c) 1967 a In 1965 did an alternator replace the earlier DC generator?
Yes or No?
Yes The body-side panels of the 1965 Convertible and Hardtop are identical. Which of the following may be interchanged between the two models?
a) Window frames
b) Doors
c) Both b Which of the following choices is true concerning the 1965's new Silent-Flo Ventilation system?

What do the letters "SFM" stand for in a Shelby VIN number?

a) Inside, a sliding control knob opens a concealed shutter in the ventilator
b) Same as a) except it is a push button
c) Same as a) except it is a switch on the dash a Which 2 of the following features were extra cost options in 1965?
a) Dual electric windshield wipers
b) Deluxe Seat Belt with retractors
c) Back-up lights b c Of the 3 1965 models, which one includes standard ash trays in the rear panels?
a) Hardtop
b) Convertible
c) Fastback b What type of side view mirror was installed on the street model GT 350?
a) Talbot-type
b) Raydyot a
a → This was a dealer installed option 1965 GT 350 rear brakes are additionally cooled on the competition cars by what?
a) Side scoops
b) A duct system installed under the car b How is the horn activated on a competition 1965 GT 350?
a) Instrument panel switch
b) Depressing the steering wheel hub
c) Buttons on the ends of the steering wheel spokes a All of the Shelby GT 350 cars for 1965 were painted Wimbleton White and had what color vinyl interiors?
a) Blue
b) Black b The lettering and the stripes of the 1965 GT 350 are formed of 3-M contact tape.
True or False?
False
(The lettering is, however, the stripes are painted to match)

In what model year did the "gills" disappear, located between the headlamps and grill?
a) 1966
b) 1967
c) 1968 b For 1967 the SelectShift Cruise-O-Matic Drive lets you drive fully automatic or shift manually through the gears.
True or False?
True In what year were the lenses of the parking-and-turn-signal lights clear?
a) 1965

Shelby-Ford-Mustang

On the 1965 GT 350 a side scoop appears on the left side of the car. What was the intended purpose for this scoop?
a) an inlet for a rear-end (differential) lubricant cooling system
b) direct cooling air over rear brake assembly a In 1966 the Shelby GT 350 was advertised as the "Son of Cobra".
True or False?
True Which of the following models presented the striking change of plastic quarter windows in place of blanking plates?
a) 1966 GT 350
b) 1965 Fastback
c) 1966 Mustang GT Fastback a Which 2 of the following are features of the 1966 GT 350?
a) Painted on side stripes
b) See-through plastic quarter windows
c) Rear brake cooling air scoops b c What color stripes did Hertz Rent a Car provide on their GT 350 rental cars?
a) Blue
b) Gold Bronze
c) Red b Four way emergency flashers became standard equipment for 1966, (optional in 1965), and are operated by a switch located where?
a) on the dash
b) on the steering column
c) in the glove compartment c Only in 1967 a GTA designation is used on the fenders. What does the "A" stand for?
Automatic (Transmission)

b) 1966
c) 1967 c

Of the following choices, which 3 are new for 1967?
a) Turn-signal lever with lane changing feature
b) Script style lettering on the fenders
c) Keylocks accommodating reversible keys
d) Tilt-Away Steering Wheel a c d Does the rear seat fold down in a standard 1967 Fastback 2 + 2? Yes or No?
No
(The extra cost Sport Deck Option provided a folding rear seat in the Fastback 2 + 2.)

New options offered in 1967 include:
a) Overhead console containing individual map lights
b) Power front disc brakes
c) Convenience Control Panel-incl. warning lights for parking brake, door open, low fuel, and seat belts
d) All of the above d In what year Mustang was the Thunderbird Special 390 CID V-8 first offered?
a) 1966
b) 1967
c) 1968 b Which one of the following is not part of the Exterior Decor Group for 1967?
a) Adjustable outside rear view mirror
b) Pop-open gas cap
c) Rear deck lid moldings
d) Functional louvered hood with built in turn signal indicator lamps a
(standard equipment)

The 1965 Mustang Fastback 2 + 2 has a 5 section louver assembly. What is the number of louvers in the pattern on a 1967 Mustang Fastback 2 + 2?
a) 8
b) 10
c) 12 c In what year was a folding glass rear window offered for the Convertible? It consisted of 2 panes of tempered safety glass, connected with translucent silicone rubber.
a) 1965
b) 1966
c) 1967 c Which of the following is standard on the hood of a GT/CS?
a) Turn-screw hood locks
b) Pin-type locks
c) New-style twist locks a What does the "CS" stand for in the term GT/CS?
California Special In 1968 the GT 500KR, promoted as "King of the Road" was the only Shelby model available for Late in 1967 a specially equipped Hardtop with GT stripes, pop-open gas cap, wheel covers, and distinctive trim was offered as a promotional effort. What was this Hardtop called?
Mustang Sprint A new standard item in 1968 was an energy absorbing steering column, and 2 spoke steering wheel. What term was used to describe these?
a) Lifeguard Design Features
b) Interior Decor Group
c) Dealer installed accessories a In 1968 the Shelby GT 500 was introduced, and featured a 355 rated horsepower 428 cubic inch engine.
True or False?
False
(introduced in 1967)

The F-O-R-D on the hood does not appear in which one of the following years?
a) 1966
b) 1967
c) 1968 c The 1968 radio antenna has what type of base?
a) Rectangular shaped
b) Rounded shape a
(previous years had a rounded shape)

The high beam indicator for 1968 is a pony that lights up when the high beams are on.
True or False?
True In what year was a new racing type rear view mirror standard?
a) 1967
b) 1968
c) 1969 c 1969 vinyl roofs are available in which 2 colors?
a) White
b) Black
c) Parchment b c Of the three 1969 models, only one has rear quarter windows that pivot open. Which one has the first time, as a Convertible.
True or False?
False
(GT 350 was available too)
The tail light assembly of the 1968 Shelby GT 350/500 and 1968 GT/CS are identical to that of the 1965 Thunderbird. Only one car has the assembly including the sequential signalling circuit. Which car does not use the sequential signal concept?
a) Shelby GT 350/500
b) 1968 GT/CS b Which Mustang does not have round parking lights?
a) 1969
b) 1965
c) 1967 a Which model had an inner scale of metric numbers added to the speedometer?
a) 1970 Boss 302
b) 1969 GT
c) 1970 Grande c "Mach I" means "The Speed of Sound," which is approximately what?
a) 740 mph at sea level
b) 743 mph at sea level
c) 739 mph at sea level b Which of the following choices is standard on the hood of the 1971 Boss 351?
a) Recessed hood locks secured by brackets
b) New-style twist locks
c) Pin-type locks
d) Turn-screw hood locks b The Mustang II suspension is based on another car's suspension, just as the original Mustang was based on the Falcon. Which car is it based upon?
a) Maverick
b) Pinto
c) Bobcat b What year was the 302 CID V-8 introduced in the Mustang II?
a) 1975
b) 1976
c) 1977 a The following slogan was created for what year Mustang? "A flame went out when old-style convertibles died. But now I'm all lit up again."
a) 1984
b) 1981
c) 1978 c
(refers to the available T-Top option)

Was the 1974 Mustang II selected by Motor Trend as their "Car Of The Year"?
Yes or No?
Yes this feature?
a) Convertible
b) Sportsroof
c) Hardtop b Which emblem appears at the hub of the 1969 standard steering wheel?
a) a silver horse with traditional red, white, and blue stripes behind it with the word "FORD" above
b) same as a, but also with the word "MUSTANG" below
c) a silver horse c What is the standard roof treatment of the 1970 Mustang Grande?
a) Conventional style vinyl top
b) ¾ Landau top
c) No vinyl top b
(conventional style vinyl top could be ordered at extra cost)

Measured against the 1973 Mustang, the Mustang II's overall length is how much shorter?
a) 14.5"
b) 18.8"
c) 17.0" b Which of the following does the Mustang II have?
a) Rack and pinion steering
b) Recirculating ball and nut gearbox a What year was the Mustang II revealed to the public?
a) 1971
b) 1973
c) 1974 b Three engines were offered in Mustang II's. However, in 1974 there were only two choices. What were they?
a) 302 CID V-8
b) 2.8 liter V-6
c) 2.3 liter four cylinder b c The Mustang II weighs more than the 1965 pony.
True or False?
True The Mustang II, circa 1963, included all of the following except what feature?
a) Front & rear bumpers
b) Removable hardtop
c) Headlight grills
d) Conventional front-mounted engine a In late 1961 basic parameters were established for the new vehicle, soon to be called Mustang. They included, the car was not to exceed 180 inches in length, weigh no greater than 2500 pounds, and the cost should not exceed what price?
a) $2,300 b) $2,500
c) $2,700 b

A dealer installed folding sun roof was a rare accessory for the 1965/66 Hardtop and Fastback 2 + 2.
True or False?
True In which years did Ford produce the most and the least number of Mustang II's?
a) '74 385,993
b) '75 188,575
c) '76 187,567
d) '77 153,173
e) '78 192,410 a d
Grand Total 1,107,718

The 1962 experimental two-seater Mustang included all of the following except what?
a) Standard front disc brakes
b) Built-in roll bar
c) 289 CID 4 barrel carburetor-equipped V-8
d) 2 separate radiators c
(powered by a rear engine 91.4 CID V-4, produced by Ford of Germany)

Ford's Mustang II, circa 1963, was unveiled to the public and was driven around the track at Watkins Glen in New York.
True or False?
True The heater and/or seat belts could be deleted, per the customers' choice, for a reduction in the selling price of a 1964½ Mustang.
True or False?
True Front & rear bumper guards were optional on 1964½ Mustangs.
True or False?
False
(they were standard)

In what year was the Ford insignia's oval color changed from black to blue, on the aluminum door sill plates?
a) 1965
b) 1966
c) 1967 c 1964½ Mustang Convertible top colors included all of the following, except which color?
a) Black
b) White
c) Blue
d) Tan d What type of rear window does the 1964½ Mustang Convertible have?
a) Zippered all-vinyl
b) Glass a 1966 GT 350H cars feature standard Mustang seat belts in the front and rear seats.
True or False?
False
(competition-type seat belts are provided in the front seats)

1964½ Mustangs were available in how many exterior colors?
a) 10
b) 15
c) 19 c

Which figure is the one listed by early advertisements as the selling price of the 1964½ Mustang?
a) $2,415
b) $2,295
c) $2,368 c Can the rear deck lid of a 1965 Fastback 2 + 2 be interchanged with one from a Hardtop or Convertible?
Yes or No?
No
(a shorter lid is used on the 2 + 2)

Race prepared 1965 Shelbys include the following gauges; Fuel pressure, oil temp., rpm, speedometer, oil pressure, and water temperature.
True or False?
True The 1965 Shelby GT 350 street version includes all of the following features, except what?
a) Detroit Locker rear end
b) Koni shock absorbers
c) Plastic rear window c
(street versions have glass rear windows)

The Shelby-American nameplate is riveted over the VIN# stamped on the left frame rail by Ford. Is this the only place the Shelby identification number can be found?
Yes or No?
If No, where else can it be found?
Stamped into right side frame rail The exhaust tips of a 1965 Shelby GT 350 exit where?
a) Beneath the rear bumper
b) Out the sides, just ahead of the rear wheels b
(a is for 1966)

The embossed inserts on the seat backs included in the Interior Decor Group, appear on both the front and rear seat backs of which 2 models?
a) Hardtop
b) Convertible
c) Fastback a b
(front seat backs only on the In April 1965 Ford introduced a new GT option. This option was offered on which of the following models?
a) Hardtop
b) Fastback
c) Convertible
d) All of the above d All of the following are features of the 1965 GT, except
a) Front fog lights
b) Rear bumper guards
c) Dual exhaust system with exhaust trumpets
d) 5-dial instrument cluster
e) Front disc brakes b If a Mustang has a Body Style Code of 65C, it is which of the following?
a) Hardtop, bench seat option
b) Fastback 2 + 2 standard interior
c) Convertible deluxe interior a
(b is 63A, c is 76B)

In 1966 the Interior Decor Group Option features all of the following. Red safety-courtesy lights at the bottom of the doors, embossed vinyl seats "pony interior", walnut trim appliques on the instrument panel & glove box door, and walnut-trimmed pistol grip door handles.
True or False?
True Match the following lettering styles of the front fender "Mustang" emblem to the correct year.
a) 1966 → 1 piece cast emblem
b) 1967 → individual block letters
c) 1968 → script style letters A folding inside door handle is new for 1968, and is used on all models.
True or False?
True The GT Equipment Group for 1968 includes which of the following?
a) Dual exhaust system with special "quad exhaust tips"
b) Wide-oval tires with special GT styled steel wheels
c) GT flip-open gas cap
d) GT fog lamps supported by horizontal grill bars
(no support bars are provided, unlike in '67) a b c The 1968 Mustang has a standard 120 mph speedometer. The optional speedometer is marked at how many miles per hour?
a) 130
b) 140
c) 150 b Beginning in 1968, the VIN# appeared on the left side of the instrument panel.
True or False?
False
(it is on the right side, in 69' it is on the left side)

Match the following door sill plates to the appropriate 1968 Shelby model.
Shelby American, Inc. → GT 500
Shelby Automotive, Inc. → GT 500 KR Featured as standard equipment for the 1968 Shelby is a console with a padded arm rest and includes a built in glove box, rear ash tray, and courtesy light.
What is embossed on the arm rest?
a) Cobra insignia
b) Word "Shelby"
c) Word "Cobra" a Which of the following is not standard equipment on a 1968 Shelby?
a) 140 mph speedometer with odometer and reset
b) Integral Overhead Safety Bar
c) Folding rear seat in the Fastback c
(the folding feature is available at extra cost)

Although the shoulder harness is standard for both the 68' Shelby Fastback and Convertible, which model has the single diagonal strap?
Convertible
(the Fastback has the dual strap)

In 1969 the Fastback 2 + 2 name was replaced with what name?
SportsRoof

Front and rear spoilers are standard on 1969 Boss 302 Mustangs.
True or False?
False
(rear spoiler is optional)

"Nearest thing to a Trans-Am Mustang that you can bolt a license plate onto," was a Ford advertisement for the 1969 Boss 302.
True or False?
True Magnum 500 wheels and Sports Slats first appeared on what model Mustang?
a) 1969 Boss 302
b) 1969 Mustang GT
c) 1968 Mustang GT a The 1969 Mustang Mach I was advertised as breaking how many USAC speed & endurance records?
a) 150
b) 295
c) 315 b Which of the following parts are all fiberglass on a 1969 Shelby GT 350/500?

Fastback)

The 3-speed Cruise-O-Matic automatic transmission was offered as an option with the 271 hp High Performance engine in 1966.
True or False?
True
(previously this engine was only available with the 4 speed manual transmission)

Mustangs exported to Germany were not called Mustangs at all, because the rights to that name were owned by someone other than Ford. What were these Mustangs called?
(HINT: the same as the original designation of the Mustang Project)
T-5

The exterior color code "D", for Acapulco Blue is an exclusive color for what year Mustang?
a) 1965
b) 1966
c) 1967 c In what year was the optional Air Conditioner first placed behind the instrument panel, with outlet vents provided?
a) 1966
b) 1967
c) 1968 b Which of the following are new features for 1968?
a) Front side marker lights & rear side marker reflectors
b) "Yield away" inside rear view mirror suspended from the windshield with former bracket omitted
c) Locking seat backs
d) Rear window defogger for Hardtop & Fastback
e) All of the above e Can the windshield of a 1968 Mustang be interchanged with any other years?
Yes or No?
No What year was the 302 CID 4V carb., 230 hp engine introduced for the Mustang?
a) 1966
b) 1967
c) 1968 c Does the familiar running horse appear on the grill of a 1968 GT/CS?
Yes or No?
No The 1968 GT/CS includes:
a) Rear deck lid with built in spoiler & special fender end caps
b) Rectangular fog lights on a blacked out grill
c) Non-functioning decorative side air scoops
d) Functional louvered hood
e) Special striping
f) All of the above f The GT Equipment Group was offered for the last time in what year?
a) 1968
b) 1969
c) 1970 b The 351 CID V-8 engine was initially offered with a 2V carburetor rated at 250 hp, or with a 4V carburetor rated at 290 hp, in what year?
a) 1968
b) 1969
c) 1970 b In 1969 the functional shaker hood scoop is standard on the Cobra Jet Ram-Air 428 engine.
True or False?
True The 1969 Boss 302 is based on the Trans-Am racing versions of the Mustang SportsRoof model, and includes a special version of the 302 CID engine.
True or False?
True The 1969 Mustang GT features include:
a) Choice of 5 V-8 engines
b) Pin-type hood locks
c) Styled steel wheels with wide oval tires
d) All of the above d Which of the following are "functional" on a 1969 Shelby GT 350/500?
a) Rear quarter panel air scoops
b) Hood scoops
c) Front fender air scoops
d) All of the above d The license plate is hinged and is placed above the rear bumper, between the tail lights on what year Shelby?
a) 1967
b) 1968
c) 1969 c What year Shelby utilizes a large cast aluminum dual exhaust outlet?
a) 1967
b) 1968
c) 1969 c Which of the following 1969 models offer highbacked bucket seats as standard?
a) Hardtop
b) Convertible
c) Shelby GT 350/500
d) Mach I c d Which 1970 model weighs the most?
a) Convertible → 3190 lb -continued a) Hood
b) Front fenders
c) Rear deck lid
d) All of the above d The black lower back panel applique is a standard feature on all of the following models for 1970, except which one?
a) Grande
b) Convertible
c) Boss 302 b Which year Mustang has "recessed" tail lamps?
a) 1968
b) 1969
c) 1970 c What is the shape of the electric clock offered as standard on the 1970 Grande, and as an option on the 1970 Mach I?
a) Round shape
b) Rectangular shape a
(rectangular electric clock is an option for other models)

New front fender side marker lights, along with new rear marker lamps (not reflectors) operate simultaneously with the turn signals for 1970.
True or False?
True Name the location of the front seatback release for the 1970 Mustang.
a) Middle side of the seat
b) Bottom side of the seat b
(69' models have the middle of the seat release)

The recessed tail lights on 1970 Boss cars feature what type of bezel?
a) Black painted bezel
b) Bright trimmed bezel a
(b used on other 70' models)

A new Boss 351 rated at 330 horsepower replaced the earlier Boss 302 model in 1971.
True or False?
True The horizontal bars & Mustang Corral return for 1971 and appear on all of the following models, except which one?
a) Hardtop
b) Grande
c) Mach I
d) Convertible c What color are the parking light lenses on the 1971 Mustang?
a) Clear
b) Amber b
(lenses were clear from 1967–1970)

Wheel opening moldings and rocker panel moldings are standard on which one of the following 1971 models?
b) SportsRoof → 3104 lb
c) Hardtop → 3080 lb a The driver's side remote mirror is standard on which of the following 1970 models?
a) Grande
b) Boss 302
c) Mach I
d) All of the above d The 1970 Mustang Grande includes which of the following as standard?
a) Special sound insulating package
b) Interior Decor Group
c) Special houndstooth check upholstery
d) Dual bodyside paint stripe
e) All of the above e Which year Boss 302 has a hood that is painted "racing black"?
a) 1969
b) 1970 a
(70' has painted hood stripes)

Where is the "Boss 302" logo located on the side stripes of a 1970 Boss 302?
a) Middle of fender
b) Top of fender b
(69' is middle of fender)

Which one of the following is not standard on a 1970 Boss 302?
a) T-Handle Hurst Shifter
b) Folding Sport Deck rear seat
c) High-backed bucket seats
d) Center console b optional A special Sports Interior Option with accent stripes was available for which 1971 model?
a) Mach I
b) SportsRoof a Flush-mounted recessed outside door handles and longer hoods featuring concealed windshield wipers were new for what year Mustang?
a) 1970
b) 1971
c) 1972 b Body-side moldings with color-keyed vinyl inserts and front bumper guards with rubber insert strips are new for 1971, and are items included in the Protection Group Option.
True or False?
True Although 1971 Mustangs were available in 16 Diamond Lustre Enamel exterior finishes, the Mach I and Boss 351 were available in only how many colors?
a) 13
b) 12
c) 11 c The new Grande emblem on the 1971 Grande's instrument panel has what type of lettering style?
a) Grande
b) Hardtop
c) Convertible a Which of the following is standard on both the 1971 Boss 351 and Mach I?
a) Fog lights
b) Front spoiler
c) Both a
(b standard on Boss 351 only)

The standard Boss 351 hood for 1971 has what features?
a) Black or argent paint treatment
b) Functional Nasa scoops
c) Pin-type locks
d) All of the above a b
(c twist locks are used)

The 1971 Boss 351 was available with an optional automatic transmission, in addition to the standard four speed.
True or False?
False
(only 4 speed manual was available)

The 1971 Boss 351 was available in 4 new "Grabber" colors, which included yellow, metallic green, lime, and blue.
True or False?
True Standard on the 1971 Boss 351, but optional at extra cost on other models, the Instrumentation Group includes gauges for which 3 of the following choices?
a) Oil pressure
b) Ampere output
c) Engine temperature
d) Fuel level a b c In 1972, part of an overall promotional effort by Ford, a Sprint Decor Option was offered on which model Mustangs?
a) Convertible
b) Hardtop
c) SportsRoof
d) All of the above b c The following items are included in the Sprint Decor Option for 1972, which is comprised of 2 packages Package A & B. Which one of the following is not included in Package A?
a) Special red, white, & blue exterior paint
b) Special USA shield on rear fenders
c) Blue & white vinyl seats with red piping trim
d) Magnum 500 chrome wheels d
(Trim rings w/color keyed hub caps were offered w/Package A)

Which 2 of the following items are standard on the 1972 Mach I?
a) Raised letter F70 × 14 tires
b) Magnum 500 chrome wheels
c) Black honeycomb grill with integral sportlamps
d) Color-keyed dual racing mirrors c d
a) Script style
b) Block letter style b "Control and Balance Make It a Beautiful Experience", was the theme for the 1972 Mustang advertisements.
True or False?
True In 1972 the Boss cars were discontinued, along with the bigger engines & performance type options. The largest engine still available was which one?
a) 351 CID 2V V-8
b) 351 CID 4V V-8
c) 302 CID 2V V-8 b
(429 Cobra Jet engines were no longer available)

Available as an option in 1972 with the 351 engines & 302 Mach I was the Dual Ram Induction system, which included how many functional NASA hood scoops?
a) 2
b) 3 a How does the word "Mustang" appear on the rear deck lid for 1972?
a) Script lettering, above right tail light
b) Separate block letters, centered a
(b is 1971)

What is the standard interior treatment for the 1972 Convertible?
a) All-vinyl
b) Knitted vinyl
c) Lambeth cloth & vinyl b
(c is Grande, a is all other models)

Which one of the following 1973 models does not have a grained black applique with bright metal moldings on the lower back body panel?
a) Hardtop
b) Convertible
c) SportsRoof
d) Grande d
(honeycomb applique is used)

Which year Mustang has tail lights surrounded by a chromed bezel?
a) 1971
b) 1972
c) 1973 c The Protection Group for 1973 includes which two new items?
a) Spare tire lock
b) Front bumper guards with rubber insert strips
c) Body side moldings
d) Door edge guards a d (a & b are optional equipment)
Approximately how much more does the 1973 Mustang weigh over the 1965 Mustang?
a) 550 lbs
b) 575 lbs
c) 600 lbs b What was the last year to include a Convertible model in the Mustang line?
a) 1972
b) 1973
c) 1974 b In what year were the sportslamps replaced in the grill with vertically mounted parking lights, and the headlights were surrounded by rectangular shaped bezels?
a) 1971
b) 1972
c) 1973 c The "Safety Certification Label" began to appear on Mustangs in what year?
a) 1969
b) 1970
c) 1971 b Up through 1965 data plates with black backgrounds indicate a car painted with what type of paint?
a) Non-acrylic enamel
b) Acrylic enamel a
(b indicated by gray background plate, beginning in 66' this was reversed)

What is the assembly plant code for the Dearborn plant?
a) R → San Jose
b) T → Metuchen
c) F → Dearborn c What does the first digit of the VIN# represent?
a) Model year
b) Assembly plant code
c) Engine code a After the race the 1964½ Festival Pace Cars were sold at a dealer auction in what city?
a) Louisville, KY
b) Nashville, TN
c) Indianapolis, IN a What color are the 1964½ Pace Car Replicas?
a) Wimbleton White color code M
b) Pace Car White color code C b Are the 1964½ Pace Car Replicas Coupes or Convertibles?
Coupes The 1964½ Pace Car Replicas have which of the following?
a) D-code 289 4V V-8 engines
b) Consecutive unit number patterns
c) Acidetch pencil markings on the radiator supports-identifying them as Pace Cars
d) All of the above b c
(Replicas have F-code 260 2V V-8 engines)

Which one of the following Ford Division sponsored dealer incentive programs awarded a free 1964½ Pace Car Replica to its winners?
a) Checkered Flag Contest
b) Green Flag Contest a
(b winners could purchase one below dealer cost)

What is the exterior color of the 1994 Pace Cars?
a) Vibrant Red
b) Laser Red
c) Rio Red c Which one of the three 1994 Mustang Pace Car types were not Cobras, but rather were based on the Mustang GT?
a) Actual
b) Festival
c) Replica b All 1994 Replica Pace Cars are consecutively numbered and have five speed transmissions.
True or False?
True In 1975 the Silver Luxury Group for the Ghia was introduced and included which features?
a) Silver metallic exterior paint w/silver ½ vinyl roof
b) Mustang II hood ornament
c) Cranberry interior w/crushed velour seat trim
d) Full console
e) Bodyside paint stripes
f) All of the above f Are the hoods of 1974 & 1975 Mustangs interchangeable?
Yes or No?
No Intermittent windshield wipers were offered as an option beginning in what year?
a) 1975
b) 1976 b The Ghia Sports Group was introduced in 1977 and includes which features?
a) Luggage rack
b) Three spoke sports steering wheel
c) Half vinyl roof
d) All of the above d The final Mustang Convertible, serial number 3F03Q259417 was built on what date?
a) June 25, 1973
b) July 4, 1973
c) August 10, 1973 a The Mustang running horse appears on the grill of the 1973 Mach I. Is the corral included?
Yes or No?
No The exterior color "Guardsman Blue" was used on which of the following Mustangs?
a) 1964½
b) 1965
c) 1966
d) All of the above a Over half of the Mustangs produced in 1965 were equipped with an automatic transmission.
True or False?
True 53.6%

The color of the actual 1964½ Pace Cars is "Pace Car White".
True or False?
False
(they are Wimbleton White)

The 1964½ Festival Pace Cars were?
a) Wimbleton White Convertibles
b) Included Pace Car lettering, stripes, & graphics made by 3M Company
c) Had either red, white, or blue interiors
d) All of the above d How many Festival 1964½ Pace Cars were produced?
a) 30
b) 35
c) 40 b The same number of Actual Pace Cars was produced in each of the years that Mustang paced the race. How many were produced in each of those years?
a) 2
b) 3
c) 4 b Which year Pace Car was built in both the Dearborn & San Jose plants?
a) 1964½
b) 1979
c) 1994 b
(other years were built in Dearborn exclusively)

How many 1979 Pace Cars were produced?
a) 9,354
b) 10,080
c) 10,478 c

Match the following 1979 Pace Car production figures to the correct model.
a) 2.3 lit. w/4 speed → 5,970 units
b) 5.0 lit. w/4 speed → 2,402 units
c) 5.0 lit. w/auto. → 2,106 units How many 1994 Festival and Replica Pace Cars were produced?
a) 60 and 1,000
b) 70 and 1,100
c) 80 and 1,200 a In 1975 the 302 CID V-8 was available only with the three speed automatic transmission.
True or False?
True
(in 76' a 4 speed manual was available)

In 1976 a sporty Stallion Package was offered on the hatchback, which included all of the following, except which features?
a) Two-tone paint/tape treatment
b) Stallion decal on front quarter panels
c) Mustang II hood ornament
d) Dual racing mirrors
e) Styled steel wheels w/raised white letter tires c In 1975 a new opera style window is an exclusive feature of what model?
a) Ghia
b) Hardtop a What type of bumper inserts does a 1974 Mustang have?
a) Stainless steel
b) Black bumper rubber strips w/white stripes a The windshield wiper/washer control was relocated from the instrument panel to the steering column on the turn signal lever, as a running change, during what model year of the Mustang II?
a) 1974
b) 1975
c) 1976 b The 1977 Deluxe Equipment Group includes which features?
a) Four way manual driver's seat
b) Power brakes
c) Radial-ply tires
d) AM/FM stereo radio
e) All of the above a b c
(d AM/FM monaural radio was included)

Which 2 of the following are new color combinations for the 1977 Cobra?
a) White w/red stripes
b) White w/green stripes
c) White w/blue stripes a b
(c introduced in 1976)

-continued

Which 2 exterior colors could the 1977 Ghia Sports Group be ordered with?
a) Black
b) Tan
c) Silver a b Sport steering wheel, styled steel wheels, bias-belted raised white letter tires, blacked-out grill, and brushed aluminum instrument panels were standard equipment in 1977 for what model?
a) Hardtop
b) 2 + 2 b In which year was the flip-up open air roof introduced?
a) 1975
b) 1976
c) 1977 c What year was the Mustang II King Cobra available?
a) 1976
b) 1977
c) 1978 c The Fox platform was utilized on a Mustang beginning in what year?
a) 1979
b) 1980
c) 1981 a The Fox platform's suspension utilizes which of the following?
a) "A" configuration upper control arm & spindle
b) MacPherson strut system b A new item for 1980 is a Sensory Map Warning Light System.
True or False?
False
(new for 1979)

What type of rear seat was offered on the 1979 Mustang hatchback?
a) Split fold down
b) Bench a The popular advertisement "The Boss is Back!" was used to promote what year Mustang?
a) 1981
b) 1982 b The 1982 Mustang GT features which of the following?
a) Reversed style hood scoop
b) Optional T-Tops
c) 1979 Pace Car style rear spoiler
d) All of the above d A Mustang Convertible became available again during what third generation model year?
a) 1981
b) 1982
c) 1983 c In what year were T-Tops an available option on the Mustang II?
a) 1977
b) 1978
c) Both a & b c In 1978 a new Fashion Accessory Package was introduced and designed w/women in mind, and included striped Fresno cloth seat inserts, driver side illuminated sun-visor mirror, a coin tray, map pockets, and a 4 way adjustable driver's seat.
True or False?
True The development process of the Mustang II was known as the "Arizona Project".
True or False?
True What year was the 4.2 liter smallblock V-8 engine introduced?
a) 1979
b) 1980
c) 1981 b In 1980 the McLaren/Firestone HPR Mustang was introduced, and featured which of the following?
a) Trans Am style flared fiberglass fenders
b) BBS wheels
c) Turbo 4 cylinder engine
d) Modified V-8 engine
e) All of the above e In 1981 a T-Top option with tinted glass was introduced for the third generation Mustangs.
True or False?
True The Mustang GT name and model came into production again in what year?
a) 1980
b) 1981
c) 1982 c Of the following choices which model year has the name "FORD" affixed to the grill? to the hood?
a) 1979 → grill
b) 1980 → hood The 1984 SVO features which of the following?
a) Off-center functional hood scoop
b) Intercooler
c) 16 inch alloy wheels
d) Black painted stripes on the tail lights
e) 1979 Pace Car style rear spoiler a b c d
(e new "dual style" rear spoiler was featured)

Was an automatic transmission offered for the 1984 SVO?
Yes or No?
No
(Borg-Warner transmission w/Hurst shifter was the choice)

Which of the following does not have red vertical style tail lights?
a) 1981
b) 1982
c) 1983 c
(c has horizontal red tail lights w/yellow turn signals)

What do the initials "SVO" stand for?
Special Vehicle Operations

To mark the Mustang's 20th anniversary in 1984, Ford introduced the limited GT 350. Based on the Mustang GT model, the GT 350 included what?
a) White exterior paint w/red GT 350 side stripes
b) White exterior paint w/blue GT 350 side stripes
c) SVO bucket seats a c
(only red stripes were offered)

The 1984 Mustang GT 350 is available in which of the following models?
a) Coupe
b) 3 door hatchback
c) Convertible b c In what year was the Saleen Mustang introduced?
a) 1983
b) 1984
c) 1985 b In 1984 Ford introduced the "Special Service Package" Mustang used by law enforcement agencies. These Mustangs were what model type?
a) Coupe
b) 3 door hatchback a The SVO for 1985 has which of the following?
a) "Premium Sound" stereo system
b) Flush mounted headlights
c) Black exterior trim
d) All of the above a b
(exterior trim was black in 84' & charcoal gray in 85')

In 1987 the 3.8 liter V-6 was discontinued for the Mustang.
True or False?
True

Flush mounted single halogen headlamps first appeared on all Mustang models in what year?
a) 1985
b) 1986
c) 1987 c In 1987 Saleen introduced?
a) The first Saleen Coupe model
b) Four wheel, five-lug standard disc brakes
c) Both c Name the first year that power What type of brakes does the 1984 SVO have?
a) Four wheel disc
b) Front disc, rear drum a The 1984 SVO had adjustable bucket seats w/manually operated lumbar support, and were available in cloth or leather, in what color(s)?
a) Charcoal gray
b) Black
c) Dark red a
(only color offered)

What type of exhaust does a 1984 SVO have?
a) Dual exhaust
b) A pair of twin pipes located off to one side b Does the "GT" symbol appear on the front fenders of a 1985 GT?
Yes or No?
No
(symbol appears on side trim between door edge and rear wheel well)

A Saleen Convertible & "R" model first became available in what year?
a) 1984
b) 1985
c) 1986 b The 1986 SVO features which of the following?
a) A third brake light in the rear spoiler
b) Chrome block style SVO letters
c) A 200 hp rating
d) All of the above d What year did Ford introduce the EFI electronic fuel injection system in the Mustang?
a) 1984
b) 1985
c) 1986 c A driver's side airbag was introduced in what year?
a) 1989
b) 1990
c) 1991 b Ford introduced a Special Edition Mustang LX Convertible in 1992. This car featured which of the following?
a) Red exterior paint
b) White leather interior
c) White top
d) White 16" wheels
e) All of the above e How many 1992 Special Edition Mustang LX Convertibles were produced?
a) 2,150
b) 2,196
c) 3,024 b What year was the "Special door locks & windows were standard on Mustang Convertibles?
a) 1989
b) 1990
c) 1991 a In 1990 Ford introduced a Limited Edition 5.0 liter LX Convertible, painted a special clearcoat green. What color was the interior?
a) White leather
b) Gray leather
c) Black leather a What is the emblem on the front of a 1993 Mustang Cobra?
a) Running horse
b) Cobra
c) Ford blue oval a The standard interior of the 1993 Mustang Cobra featured 1993 GT trim. Which of the following are optional interiors?
a) Ebony leather
b) Opal Gray leather
c) White leather a b Which of the following are available exterior colors for the 1993 Cobra?
a) Crystal White
b) Vibrant Red
c) Ebony
d) Teal Metallic b c d In 1993 Ford introduced Limited Edition Monochromatic yellow and white Mustang LX Convertibles. Match the number produced for each model.
a) 1,460 → White
b) 1,419 → Yellow How many 1993 Cobra R-models were built?
a) 98
b) 107
c) 114 b When was the first Structural Prototype completed for SN95?
a) Late June 1991
b) Early August 1991
c) Mid October 1991 b The 1994 Mustang platform is a highly modified & improved version of the Fox platform. What is it called?
a) "Fox-2"
b) "Fox-3"
c) "Fox-4" c The 1994 Mustang Convertible is produced alongside the Coupe on the Dearborn assembly line.
True or False?
True How many of the 1994 Mustang's parts are "new" for that model year?
a) 1,210

Vehicle Team" Division created?
a) 1990
b) 1991
c) 1992 c

The 1993 Cobra features which of the following?
a) 235 hp modified 5.0 liter engine
b) Borg-Warner T-5 transmission
c) SVO clutch
d) Four wheel disc brakes
e) 17" seven spoke wheels
f) All of the above f How many Saleen "10th Anniversary Mustangs" were built?
a) 10
b) 15
c) 20 a In 1986 Ford planned to replace the rear wheel drive Fox platform Mustang w/a front wheel drive Japanese platform, code named ST16, scheduled to be the 1987 model Mustang.
True or False?
True When did "Team Mustang" begin to assemble?
a) Summer of 1990
b) Fall of 1990 a The new Mustang program became known as the code name SN95. The "S" denotes that the Mustang is in the small specialty car segment, and the "N" denotes that North America has the main responsibility for design. Does the "95" represent anything significant?
Yes or No?
No (used by Ford for administrative purposes)

Which one of the following designs was selected and approved to be the basis for the 1994 Mustang?
a) "Rambo"
b) "Arnold Schwarzenegger" b The 1994 Mustang is available in how many exterior colors?
a) 10
b) 11
c) 12 b Which features are included on 1994 Mustangs bound for export to Japan?
a) Wheel lip moldings
b) Side markers
c) Amber colored section of tail lights
d) All of the above d The 1994 Mustang made its official debut at the State Fair of Texas.
True or False?
True The 1994 Mustang received Motor Trend's "Car of the Year" award.
True or False?

b) 1,330
c) 1,395 b

Which of the following are available for the 1994 Mustang?
a) 105 hp 2.3 liter OHC four cylinder engine
b) 145 hp 3.8 liter V-6 engine
c) 215 hp 5.0 liter V-8 engine b c Was the 1994 Mustang color "Iris Clearcoat Metallic" discontinued for 1995?
Yes or No?
Yes "Sapphire Blue Clearcoat Metallic" is a new Mustang color for 1995. Is it an exclusive color for the GT?
Yes or No?
Yes Which of the following are standard equipment on the 1994 Mustang?
a) 12-volt auxiliary outlet for operating small electrical accessories
b) Split fold down rear seat (Coupe only)
c) Tilt steering wheel
d) Full center console
e) All of the above e The 1994 Mustang Convertible top is available in which of the following colors?
a) Navy blue
b) Saddle
c) White
d) Black b c d The rear windows of 1994 & 1995 Mustang Convertibles are glass and feature a defroster as standard.
True or False?
False
(defroster is optional)

1994 Mustangs have dual airbags and four wheel disc brakes as standard equipment.
True or False?
True What type of air conditioning refrigerant does the 1994 Mustang use?
a) R-12
b) R-134a b GTS Mustangs were only available in which one of the following model years?
a) 1993
b) 1994
c) 1995
d) 1996 c Where does the "GTS" designation appear on a GTS Mustang?

True

Which of the following 1994 Mustang colors is an exclusive color for the GT?
a) Laser Red
b) Rio Red
c) Canary Yellow c 1966 Shelby GT 350H cars were available with either manual or automatic transmissions.
True or False?
True In 1968 a special model Mustang was produced alongside other Mustangs on the San Jose assembly line, and was offered by Colorado Ford Dealers. This model is known as the "HCS". What do these letters stand for?
High Country Special Both 1993 and 1994 Mustang GT models have identical drag coefficient numbers. Which one of the following is the correct answer?
a) 0.38
b) 0.35 1994 Base model
c) 0.40 1993 LX model a The 1994 Mustang Convertible has which of the following features?
a) Rocker panels made from thicker gauge metal
b) A bolt-on brace added under the engine
c) A tuned vibration damper installed inside the right front wheel well
d) All of the above d How many wheel/tire packages are offered for the 1994 Mustang?
a) 3
b) 4
c) 5 b Which of the following are included as standard equipment for the GTS Mustang?
a) Fog lamps
b) 5 speed transmission
c) 16 inch wheels
d) Sport suspension
e) All of the above b c d Which one of the following is available as optional equipment for the GTS Mustang?
a) GT sport seats
b) 17 inch wheels
c) Rear spoiler
d) Leather-wrapped steering wheel b How many "ponies" appear on a front bucket seat from the Interior Decor Group?
a) 6
b) 7
c) 8
d) 9
e) 10 c Which of the following exterior colors is an exclusive Mustang GT color for 1996?

a) Window sticker
b) Fender badges
c) Rear bumper a
(only appears here, car features typical GT identification)

GTS Mustangs are available both as Coupe and Convertible models.
True or False?
False
(Coupe only)

The 4.6 liter SEFI V-8 engine was introduced in what year for the Mustang GT?
a) 1994
b) 1995
c) 1996 c 1996 Mustangs feature what style taillamps?
a) Horizontal
b) Vertical b The "locking steering column" feature was introduced and available on all models in what year?
a) 1969
b) 1970
c) 1971 b To accommodate a variety of drivers, which of the following can be adjusted forward or back a total of four inches in the 1962 Mustang I?
a) Bucket seats
b) Foot pedals
c) Steering column b c
(seats are immobile)

The manufacturer's serial number data plate for the 1962 Mustang I is 1M1500. What does the "1500" signify?
a) Engine displacement, 1500 cubic centimeters
b) Weight in pounds a
(car weighed 1544 lbs with 13 gal. of gasoline)

Which of the following could not be ordered on a 1969 or 1970 Boss 429?
a) Air conditioning
b) Power steering
c) Manual front disc brakes
d) Automatic transmission a d
(b & c standard items)

Although 1969 and 1970 Boss 429 buyers had a choice of interior colors, which of the following were available only in black?
a) Carpet
b) Door panels
c) Headliner
d) Dashboard
e) Seat color a c d 1969 and 1970 Boss 429 Mustangs came off the Dearborn assembly line and were shipped to Kar Kraft in Brighton, Michigan. The completed cars arrived with the Boss 429 engine already installed.
True or False?
False
(The cars arrived with the 428CJ engine already installed.)

The Monroe Auto Equipment Co. sponsored a promotional a) Bright Tangerine Clearcoat
b) Deep Violet Clearcoat Metallic
c) Moonlight Blue Clearcoat Metallic a 1996 Mustang interior colors include all of the following except which color?
a) Saddle
b) Medium Graphite
c) Black
d) White
e) Bright Red e All 1973 Mustang engines were fitted with emission control equipment, and included EGR pumps. What do the letters "EGR" stand for?
Exhaust gas recirculation Which of the following are standard for 1973 Mustang Convertibles?
a) Power top
b) Deluxe rim-blow horn three-spoke steering wheel
c) Power front disc brakes a c The Mustang II King Cobra is available with what type of transmission?
a) Four-speed manual
b) Three-speed automatic
c) Both a A MPG model Mustang II was offered in 1975 with a 3.18:1 rear-axle ratio and catalytic converter, and was quoted to have which of the following mileage ratings?
a) 38 hwy, 27 city
b) 36 hwy, 25 city
c) 34 hwy, 23 city
d) 32 hwy, 21 city c Which of the following engines is standard for the 1976 Mustang Cobra II?
a) 302 CID V-8
b) 2.8 liter V-6
c) 2.3 liter four cylinder c The Monroe Auto Equipment Co. sponsored a promotional Mustang II called the Monroe Handler. Racing engineer Trevor Harris modified the suspension, and Jack Roush built up the 302 engine which was rated at how many horsepower?
a) 400 hp
b) 375 hp
c) 350 hp a Which year was the Cobra package for the third generation Mustang not available?
a) 1979
b) 1980
c) 1981
d) 1982 d What was the last year the name "Ghia" was used for the Mustang?
a) 1981
b) 1980
c) 1979 a Which of the following engines is available with the twentieth anniversary 1984 Mustang GT 350?
a) Turbo charged four cylinder
b) 3.8 liter V-6
c) 5.0 liter H.O. a c The 1984 Mustang SVO has Koni shocks and struts which can be externally adjusted by the owner. A brochure and plastic adjustment knob were included in the glove box. The adjustment positions are called, in increasing order of stiffness, "City Ride", "Cross Country", "GT/ Aggressive Driving", and "Competition". What position were the shocks installed in on the 1984 SVO?
City Ride Which of the following engines was standard in the 1987 Mustang LX Convertible?
a) 2.3 liter four cylinder
b) 3.8 liter V-6 a
(The 3.8 liter V-6 was no longer available for the Mustang.)

The five-speed manual transmission is standard on all 1987 model Mustangs.
True or False?
True In which of the following model years was the T-Top option discontinued?
a) 1986
b) 1987
c) 1988
d) 1989 c In 1990 5.0 liter LX and GT Mustangs were fitted with speedometers that were no longer marked to 85 miles per hour. Instead, they were now marked at how many miles per hour?
a) 130 mph
b) 140 mph
c) 150 mph b The interior of the 1994 Cobra is available in which of the Mustang II called the Monroe Handler. How many 1977 regular production Cobra IIs were converted into Monroe Handlers by Dave Kent and his firm Creative Car Craft?
a) 7
b) 8
c) 9
d) 10 b In what year did Ford sell the least amount of SVO Mustangs?
a) 1984
b) 1985
c) 1986 b
(only 1,954 cars sold in 1985)

Match the following SVO model years to their corresponding horsepower ratings.
a) 1984 → 175 hp
b) 1985 → 205 hp
c) 1986 → 200 hp Which of the following are options for the Mustang SVO?
a) Air conditioning
b) Power windows/door locks
c) Leather seats
d) Flip-up sunroof
e) AM/FM stereo cassette radio
f) All of the above f In what year were the designations L, GL, and GLX first used?
a) 1980
b) 1981
c) 1982
d) 1983 c How many 1994 Cobra R models were produced?
a) 200
b) 250
c) 300 b 1995 Cobra R models are only available in the exterior color Crystal White.
True or False?
True Which of the following features does the 1995 Cobra R have?
a) Racing fuel cell
b) Hand-cranked windows
c) No radio
d) No back seat
e) All of the above e What is the horsepower rating of the 1994 Cobra?
a) 240 hp
b) 225 hp
c) 260 hp
d) 215 hp a
(The 1994 Mustang GT is rated at 215 hp.)

Which of the following features does the Mach III following colors?
a) Black
b) Saddle
c) Opal Gray
d) All of the above a b The 1978 Mustang Mach I features which of the following engines as standard?
a) 2.3 liter four cylinder
b) 2.8 liter V-6
c) 302 CID V-8 b A blackout grill is a standard feature on which of the following 1978 Mustang II models?
a) Hardtop
b) Ghia
c) Mach I
d) 2 + 2 c d
(Hardtop & Ghia feature an argent grill.)

On what date did Mustang production begin?
a) March 9, 1964
b) March 16, 1964
c) March 23, 1964 a In 1964 it took an average of how many hours to build a Mustang in the Dearborn plant?
a) 24 hours
b) 25½ hours
c) 27½ hours
d) 29 hours c 5F08F100001 is the first production Mustang and resides in the Henry Ford Museum in Dearborn, Michigan. Identify the type (Coupe or Convertible), and colors (exterior and interior) of this Mustang.
Convertible, Wimbleton White, Black vinyl In what year did Mustang production end at the San Jose, California plant?
a) 1981
b) 1982
c) 1983 b In 1965 the five-dial instrument cluster was available with which of the following?
a) GT Equipment Group
b) Interior Decor Group
c) Both c prototype have?
a) Supercharged 4.6 liter modular V-8
b) 450 horsepower rating
c) Six-speed Borg-Warner T-56 transmission
d) All of the above d Captain Stanley Tucker, an airline pilot from New Foundland, Canada and the owner of the first Mustang traded in 5F08F100001 for the 1,000,001th Mustang. Is the one millionth Mustang a Coupe or Convertible, and what is its exterior and interior color(s)?
Convertible, Silver Frost, Black vinyl (pony)

On what date did the San Jose, California plant begin producing Mustangs?
a) July 6, 1964
b) July 13, 1964
c) July 20, 1964
d) July 27, 1964 b The San Jose, California plant had to shift 1964 Falcon and Fairlane production to two other plants respectively, in order to begin Mustang production. Match the following two plants to the appropriate model shifted from San Jose.
a) Lorain, Ohio → Falcon
b) Kansas City, Missouri → Fairlane The Metuchen, New Jersey plant assembled 1965 Falcons and Comets. On February 1, 1965 Metuchen built its first Mustang, and continued to produce which one of the following models?
a) Comet
b) Falcon a
(Falcon production was added to Lorain, Ohio.)

To prepare for Pinto production, Mustang production ended at the Metuchen, New Jersey plant in what year?
a) 1969
b) 1970
c) 1971

Walt Disney's Magic Skyway exhibit at the 1964 New York World's Fair included nearly 150 new Ford Convertibles. Of this number, how many were Mustangs?
a) 10
b) 11
c) 12
d) 13
e) 14

The Mustang Convertibles included in Walt Disney's Magic Skyway exhibit at the 1964 New York World's Fair all received a six digit Special Order DSO code of 840027, which called for all to be equipped with 260 2V V-8s, Cruise-O-Matic transmissions, and 3.00:1 non-locking differentials.
True or False?
True What is the exterior and interior colors of the Mustang Convertibles included in Walt Disney's Magic Skyway exhibit at the 1964 New York World's Fair?
a) Wimbleton White, Red vinyl
b) Raven Black, Red vinyl
c) Rangoon Red, Black vinyl a A Special Vehicle Order with a DSO code of 842011 was placed on Nov. 9, 1964 for Mustang Convertibles to be used at the 1965 New York World's Fair, in the Walt Disney Magic Skyway exhibit. These vehicles were identically equipped with Cruise-O-Matics, and which type of engine?
a) 289 2V V-8
b) 200 1V Six b The Mustang Convertibles used in Walt Disney's Magic Skyway exhibit at the 1965 New York World's Fair were shipped to Carron and Company in Michigan to receive which of the following preparations?
a) Fuel tank and powertrain removal
b) Conveyor attachment point welding
c) Door courtesy lamps of 1964–65 Thunderbird
d) All of the above d In which three of the following colors were the 1966 High Country Special Mustangs available?
a) Tahoe Turquoise
b) Aspen Gold
c) Timberline Green
d) Springtime Yellow
e) Columbine Blue b c e Of the following items, name the one that was available as an option for 1965 and 1966 Mexican made Mustangs (The other items were not available).
a) Automatic transmission
b) Power steering
c) Power brakes
d) Heater/defroster
e) Air conditioning d Which one of the following components for 1965 and 1966 Mexican made Mustangs was sourced from the United States, rather than Mexican suppliers?
a) Sheetmetal
b) Glass
c) Transmission
d) Rear axle
e) Alternator a Which one of the following components for 1965 and 1966 Mexican made Mustangs was sourced from Mexico, rather than the United States?

Carroll Shelby and his development driver and engineer Ken Miles specially modified and developed how many 289 High Performance 1964½ Mustang Coupes?
a) 2
b) 3
c) 4 a Which of the following plants first used body buck tags late in 1965?
a) Dearborn
b) San Jose
c) Metuchen a c The District Sales Office coding format changed for Ford Division vehicles, and Ford's Canadian sales districts were assigned their own DSO codes, effective on what date?
a) January 1, 1966
b) January 10, 1966
c) January 15, 1966 a In 1966 Ford offered the Sprint 200 Mustang, featuring the six cylinder engine. Was this Sprint Mustang available in all three body styles?
Yes or No?
Yes The 1966 Sprint 200 Mustang package included which of the following items as standard?
a) Wire style wheel covers
b) Console
c) Body side accent stripes
d) Chrome engine air cleaner with Sprint 200 decal c
e) Interior Decor Group a b c d To commemorate the One Millionth Anniversary of the Mustang in March 1966, Ford produced a limited edition Mustang painted Anniversary Gold, (no color code), and featured a six digit DSO code. What body style was this Mustang available in?
a) Hardtop
b) Fastback
c) Convertible
d) All of the above a The 1966 High Country Special is a rare and limited edition Mustang. This model was produced in the Coupe and Convertible body style only.

True or False?
False
(Fastback was also included)

All 1966 High Country Special Mustangs were:
a) Assembled at the San Jose plant
b) Given scheduled assembly date of 15G (July 15th)
c) Given six digit DSOs beginning with 51 (for Denver)
d) Shipped to 100 dealers in Colorado, Wyoming, and Nebraska
e) All of the above e In what year did Ford's Mexican operation, Ford Motor Company, S.A., begin assembly of both Shelby de Mexico street and race version GT 350s?
a) 1965
b) 1966
c) 1967
d) 1968 c The West German firm Humbold-Klockner-Dautz, a manufacturer of diesel trucks, locomotives, and marine engines, owned the copyright to the Mustang name in that country in 1964. Ford declined the firm's offer to rescind its copyright to the Mustang name for $10,000, and marketed the car under a different name.
True or False?
True The "Mustang" name had to be deleted from how many different places on 1965 models exported to West Germany?
a) 7
b) 8
c) 9
d) 10 b
(4 wheelcovers, 2 fender emblems, steering wheel center, & gas cap)

Although the word "Mustang" was deleted from 1965 models exported to West Germany, did the running horse emblem in the grill and on the glove box door remain?
Yes or No?
Yes A special one-of-a-kind 1964½ Mustang was made for Henry Ford II, and was produced during the first day of Mustang production. What was the exterior color of this Mustang Coupe?
a) Guardsmen Blue
b) Rangoon Red
c) Raven Black
d) Wimbleton White c Checkered Flag Contest winners were invited to the "Checkered Flag Winners Day in Dearborn" on May 14th, 1964. How many dealers won?
a) Upholstery
b) Chrome trim
c) Clutch assembly
d) Dashboard
e) Instrument cluster c The standard Hardtop was the only body style available for Mexican made Mustangs in 1965 and 1966.
True or False?
True The special one-of-a-kind 1964½ Mustang Coupe made for Henry Ford II included which of the following features?
a) Black leather seats, headliner, and dash pad
b) Interior teakwood appointments
c) Fog lights
d) Styled steel wheels with trim rings
e) GT style exhaust trumpets
f) All of the above f At which two of the following plants did 1966 Mustang production begin on August 16, 1965?
a) Dearborn
b) San Jose
c) Metuchen a b
(Metuchen's production began on August 25, 1965)

What type of transmission(s) did the 1964½ Pace Car Replicas have?
a) Automatic
b) Four-speed manual
c) Both a The 1964½ "Actual" Pace Cars featured the 289 High Performance "K" engine, and four-speed manual transmissions.
True or False?
True Because the 1964½ Festival Pace Cars were not ready for distribution to the Indy 500 officials, Ford supplied them with 35 Galaxies in March. The first week in May they were replaced with the Mustang Pace Cars.
True or False?
True What was the length of the warranty period offered for the 271 hp High Performance 289 cubic inch engine and its related powertrain components a) 100
b) 105
c) 110
d) 115 b Winners of the Checkered Flag Contest and Green Flag Contest in 1964 received a promo pace car Mustang inscribed with either "Winner—Checkered Flag Contest" or "Winner—Green Flag Contest", free of charge.
True or False?
True What letter appears on the black underdash air vent control knob on a 1964½ Mustang?
a) A
b) V a In which month of 1964 was the 170 cubic inch six cylinder solid-lifter engine replaced by a 200 cubic inch six cylinder engine?
a) June
b) July
c) August c How many interior colors were offered at the introduction of the 1964½ Mustang?
a) 4
b) 5
c) 6 b
(White, Black, Blue, Palomino, & Red)

On which of the following 1965 models were rocker panel moldings standard?
a) Fastback
b) Convertible
c) Coupe a
(optional on other models)

Which of the following engine(s) could be ordered with a 1965 Mustang GT?
a) 200 hp 289ci C-code
b) 225 hp 289ci A-code
c) 271 hp 289ci K-code b c Rear quarter panel trim is deleted on which of the following for 1965?
a) Coupe
b) Convertible
c) Fastback
d) Models with the GT Equipment Group c d Are the chrome steering wheel horn rings interchangeable between 1964½ and 1965 Mustangs?
Yes or No?
No 1964½ Mustangs feature gas caps with wire loop retainer rings.
True or False?
False for 1964½ Mustangs?
a) 3-months or 4,000-miles
b) 12-months or 12,000-miles
c) 24-months or 24,000-miles a The fender emblem for 1964½ through 1966 Mustangs equipped with the 289 cubic inch "Hi-Po" engine featured the number "289", the words "High Performance", and two checkered flag type symbols.
True or False?
True The Mustang Order Holding Program was designed for customers awaiting delivery for a new 1964½ Mustang. A scale-model Mustang, an "Original Edition" nameplate, and special gift cards would be sent to customers. The program terminated on what date and was limited to the first, how many buyers?
a) July 1, 1964 40,000
b) July 31, 1964 50,000 b Dual Red Band tires were an option for 1964½ Mustangs, and cost $48.97. Were these offered as standard with the High Performance Package?
Yes or No?
Yes The Mustang II created in 1963 had which one of the following engines?
a) 164 hp 260ci V-8
b) 210 hp 289ci V-8
c) 271 hp High Performance V-8 c 1965 Mustangs feature which of the following?
a) Adjustable position passenger seat
b) All vinyl interiors
c) 13 inch wheels
d) All of the above a b
(14 inch wheels standard with 6.95 × 14 tires)

Where is the horn mounted on a 1965 Mustang?
a) High on radiator core support
b) On the frame in engine compartment a
(1964½ horns are mounted on the frame)

A bench seat was first offered on 1965 models.
True or False?
True

In which of the following colors are 1965 Mustang Convertible tops available?
a) Black
b) Blue
c) Tan
d) White
e) All of the above a c d Which type of Styled Steel Wheel is featured on 1966 Mustangs?
a) Chrome wheels with chromed rims (added on early 1965 models)

Match the following base prices to the three 1966 models.
a) Hardtop → $2,416
b) Convertible → $2,653
c) Fastback → $2.607

Which of the following items are standard for 1966 Mustangs?
a) Front and rear seat belts
b) Exterior mirror
c) Padded sun visors
d) Emergency flashers
e) Backup lights
f) All of the above f Rocker panel moldings and chrome hood lip trim are standard for all 1966 model Mustangs.
True or False?
True What color is the evaporator case facing on air conditioning units for 1966 Mustangs?
a) Silver
b) Black b Which of the following items are included in the Visibility Group for 1966?
a) Tinted windshield
b) Remote control mirror
c) Day/Nite interior mirror
d) Two-speed electric windshield wipers b c d 1966 Convertible top codes included "B" for black manual, and "S" for black power. Match the following other two codes for "white manual", and "white power".
a) "C" → White manual
b) "T" → White power Ford began offering an AM/FM radio option during the 1966 model year.
True or False?
True "Bred first to be first! . . . Mustang '6_", is an example of early advertising for what year Mustang?
a) 1965
b) 1966
c) 1967
d) 1968 c The 1967 Tilt-Away steering wheel option for $59.93 adjusted to how many different driving positions?
a) 7
b) 8
c) 9
d) 10 c Representatives of the Dallas
b) Chrome wheels with trim rings over plain black rims b Which is true for the Rally-Pac for 1966?
a) Color-keyed to the interior
b) Always black a In which of the following years was a special GT gas cap featured on GT Mustangs?
a) 1965
b) 1966
c) Both b What color were 1966 engine blocks, valve covers, and standard air cleaner assemblies painted?
a) Ford Corporate Blue
b) Gold
c) Black a In what year was the Thermactor Exhaust Emission Control System installed on Mustangs destined for delivery to California?
a) 1965
b) 1966 b In October 1965 Ford offered a special 16" motorized model Mustang GT in which of the following body styles and colors?
a) Convertible - Wimbleton White
b) Fastback - Raven Black
c) Hardtop - Poppy Red
d) All of the above c Canadian Ford dealers in the Toronto area offered their own 1967 Sprint version as a "Third Birthday Treat" in April. Which three of the following colors were available for these cars?
a) Acapulco Blue
b) Springtime Yellow
c) Thunderbird Diamond Green
d) Candyapple Red b c d 1967 Mustang GTs could be ordered with two and four-barrel V-8 engines, and both were equipped with dual-quad exhaust tips.
True or False?
False
(Two-barrel V-8 cars received standard turndown tailpipes.)

The Lower Back Panel Grille, an option for 1967 costing $19.48 could only be ordered in conjunction with the Exterior Decor Group. The grille could be painted in body color or Dark Gray Metallic (Flat) paint.
True or False?
True What color center caps do Styled Steel wheels for 1967 have?
a) Blue
b) Black
c) Red
d) Green a In which following year were District Sales Office created Blue Bonnet Special Mustangs from 1967 Sports Sprint Mustangs. Which of the following features did these cars include?
a) V-8 and six cylinder engines
b) Convertible body style
c) Blue Bonnet Blue exterior factory paint
d) Exterior Decor Group
e) "Lone Star Limited" fender badges a c d e Which of the following were offered in the Interior Decor Group for 1967?
a) Brushed-aluminum inserts in the dashboard and door panels
b) Chrome trim over top of front bucket seats
c) Simulated woodgrain steering wheel
d) Lower door grilles with integral radio speakers and courtesy lights
e) All of the above e If a buyer ordered a floor console in 1967, did they also have to order a radio?
Yes or No?
Yes The Sports Sprint Option offered midway through the 1967 model year was available with both six cylinder and V-8 engines. Which of the following body styles was it available in?
a) Hardtop
b) Convertible
c) Fastback a b What was the last year that the K-code High Performance 289 cubic inch engine was available?
a) 1966
b) 1967
c) 1968 b Beginning in what year did the traditional tri-color bar and running horse front fender emblem include the cubic inch displacement designation?
a) 1966
b) 1967
c) 1968 b In which year was a new collapsible spare tire introduced?
a) 1966
b) 1967
c) 1968 c Styled Steel wheels for 1968 were:
a) Offered for all V-8 models
b) Painted argent or chromed
c) Included GT center caps for GTs or were plain for non-GT models
d) Had a ten-hole design
e) All of the above a b c
(twelve-hole design)

Which of the following items were offered by Ford dealers in 1968?
a) Speed Control
b) Automatic Headlight Dimmer Mustang center consoles with seatbelt "holsters" available?
a) 1965
b) 1966
c) 1967 c At what level does a warning light for low fuel illuminate on the Convenience Control Panel which is an option for 1967?
a) Under 2 gallons
b) Under 3 gallons
c) Under 4 gallons c Which model year Mustang has body-colored simulated side air intake scoops?
a) 1966
b) 1967
c) 1968 b Which one of the following appears on the sides of a 1968 Mustang GT?
a) C-stripe
b) Lower body panel stripe a The 1968 Mustang GT includes the small rear quarter panel chrome trim.
True or False?
True In which of the following years was a front bench seat not offered for the Mustang Convertible?
a) 1965
b) 1966
c) 1967
d) 1968 d The equipment package Sprint A for 1968 Mustangs was available with either six cylinder or V-8 engines, while the package Sprint B was available with V-8 engines only.
True or False?
True Argent painted Styled Steel wheels with E70 Wide Oval white sidewall tires are part of which Sprint package for 1968?
a) Sprint A
b) Sprint B b On what date in 1968 did Ford introduce the Mustang GT 428 cubic inch Cobra Jet?
a) April 1st
b) May 1st
c) June 1st a c) Body side moldings
d) Door edge guards
e) Deluxe Headrests
f) All of the above f Which one of the following represents the "earlier" version of the rear quarter red reflectors on 1968 Mustangs?
a) Framed by integral body-color rectangles
b) Surrounded by chrome bezels with rounded corners a (Design was modified in Feb. 1968 to b) style)

The equipment package Sprint A for 1968 Mustangs includes all of the following except:
a) C-stripe
b) Wheel lip moldings
c) Full wheel covers
d) Grill mounted fog lamps
e) Pop-open gas cap d (included in Sprint B package)

The 1968 Mustang 428 cubic inch Cobra Jet is available in all three body styles, however most were produced in which one of the following body styles?
a) Hardtop
b) Fastback
c) Convertible b The 1968 Mustang 428 cubic inch Cobra Jet could be combined with which of the following transmissions?
a) Four-speed manual
b) C4 SelectShift Cruise-O-Matic
c) C6 SelectShift Cruise-O-Matic
d) All of the above a c Which one of the following codes represents the 1968 Mustang 428 cubic inch Cobra Jet engine?
a) R
b) S
c) X
d) J a An 8000 rpm tachometer is standard for 1968 428 cubic inch Cobra Jet Mustangs with which of the following transmissions?
a) Four-speed manual
b) C6 SelectShift Cruise-O-Matic
c) Both a (optional with C6)

Which of the following are standard items for the 1968 Mustang 428 cubic inch Cobra Jet?
a) Front disc brakes
b) Functional Ram Air hood scoop
c) Broad black centered hood stripe
d) Starter motor delay
e) "Power by Ford" chromed valve covers
f) All of the above b c d e Batteries were originally mounted in the trunks of 1965 GT 350s, but were later relocated to the engine compartment due to fumes and corrosion problems.
True or False?
True The "Tunnel-Port" 302 cubic inch engine was an available option for 1968 Mustangs.
True or False?
False The 1968 Mustang GT/CS could be ordered with any of the engines available that year, including the 200 cubic inch six cylinder.
True or False?
True Was the Thermactor anti-smog system required on the 428 cubic inch Cobra Jet engine?
Yes or No?
Yes Which of the following are Special "Color of the Month" promotional colors for 1968?
a) Passionate Pink
b) Emerald Green
c) Nugget Gold
d) Black Hills Gold
e) All of the above a b d Shelby American had to produce at least 100 cars before the end of 1964, to qualify the 1965 GT 350 for SCCA B/Production competition.
True or False?
True What type of gas cap is featured on a 1965 Shelby GT 350?
a) Stock Ford Mustang cap
b) Cobra logo GT 350 cap a (b is standard for 1966 production year)

Which of the following steering wheels was used first on the early 1965 Shelby GT 350s?
a) 15 in-diameter wood wheel with Cobra logo center cap
b) 16 in-diameter wood wheel with Cobra logo center cap b How many 1965 Shelby GT 350 R-Models were built?
a) 32
b) 36
c) 38 b (34, plus 2 prototypes)

The 1965 Shelby GT 350 is powered by the 271 hp Hi-Po engine. After a few external modifications, the Shelby was advertised with which of the following horsepower ratings?
a) 295 hp
b) 300 hp
c) 306 hp c Which of the following gauges are included in the Shelby American installed, custom-crafted dash pod of the 1965 Shelby GT 350?
a) Oil temperature
b) Oil pressure
c) Delco tachometer unit b c How many 1965 Shelby GT 350s were built specifically for drag racing?
a) 5
b) 7
c) 9 c Are stock front and rear bumpers eliminated on 1965 Shelby GT 350 Competition models?
Yes or No?
Yes As a weight saving measure, the stock Mustang side glass and window regulators were replaced with aluminum-framed plastic side windows with lift straps, on the 1965 Shelby GT 350 R-Model.
True or False?
True The 1965 Shelby GT 350 R-Model retained the C-pillar air vents.
True or False?
False (An aluminum plate was riveted over the holes.)

1966 Shelby GT 350s were available in a choice of exterior colors, besides Wimbleton White which included Candyapple Red, Raven Black, Ivy Green, and Sapphire Blue, and featured white side and Le Mans stripes.
True or False?
True Detroit Locker rear ends are standard equipment for which of the following model year Shelby GT 350s?
a) 1965
b) 1966
c) Both a (optional in 1966)

Koni shock absorbers are a dealer installed option on 1965 Shelby GT 350s.
True or False?
False (standard on 1965 cars and carryover cars, dealer installed option in 1966)

1965 Shelby GT 350 R-Models have custom-built fuel tanks fabricated from two bottom sections of the stock Mustang 16 gallon tank. What is the capacity in gallons of the special R-Model tank?
a) 30
b) 32
c) 34 c Where is the 1965 Shelby GT 350 gas filler inlet located?
a) Inside the trunk
b) Outside, same position as the stock Mustang inlet a The 1965 Shelby GT 350 street and R-Model versions share the standard black Mustang door panels.
True or False?
False (A textured aluminum sheet replaces the standard inner door panel on R-Models.)

What type of driver's seat is featured in 1965 Shelby GT 350 R-Models?
a) Naugahyde-covered lightweight fiberglass racing seat
b) Standard Mustang bucket seat
c) Both types were used c How many original Shelby K-code Convertibles were created during the 1966 production year?
a) 4
b) 5
c) 6
d) 7 c In which of the following Shelby GT 350 model years is the Mustang rear seat retained?
a) 1965
b) 1966 b The Shelby GT 350 carryover cars from 1965 have what color engine blocks?
a) Black
b) Blue a (later 1966 models are blue)

What is the maximum rpms shown on the dashpad mounted tachometer of a 1966 Shelby GT 350?
a) 7000
b) 8000
c) 9000 c Which of the following wheels are standard for the regular production 1966 Shelby GT 350 (excluding carryover cars)?
a) 15 in. Ford station wagon, silver-painted steel
b) 15 in. five-spoke Cragar/Shelby aluminum
c) 14 in. aluminum-alloy Shelby ten-spoke What year were automatic transmissions offered for Shelby GT 350 models?
a) 1965
b) 1966
c) Both b Late in what production year was the Paxton/Cobra supercharger factory option made available by Shelby American?
a) 1966
b) 1965 a Most of the 1966 Shelby GT 350 Hertz cars received 14 inch chromed Magnum 500 wheels with unique red and gold corporate decals for the center caps that read "Hertz Sports Car Club".
True or False?
True Which features were included with 1966 Shelby GT 350 Hertz cars?
a) Front disc brakes
b) Dash-mounted tachometers
c) Rear seats
d) Radios
e) All of the above e What model year Shelby was promoted as "The Road Cars"?
a) 1965
b) 1966
c) 1967 c Which of the following were optional wheels offered for the 1967 Shelby?
a) 15 in. Kelsey-Hayes MagStar units
b) 15 in. ten-spoke cast aluminum units
c) 15 in. five-spoke Cragar/ Shelby aluminum units
d) All of the above a b Early production 1967 Shelby models featured small red running lights installed in the C-pillar scoop. Due to legal difficulties with some states, the lights were phased out of production early on in the model year.
True or False?
True 1967 Shelby interior colors include which of the following?
a) Red
b) Black
c) Parchment
d) White
e) All of the above b c d Which one of the following is the only 1967 Shelby color that was not also a Mustang color for that model year?
a) Metallic Gray
b) Lime Gold
c) Bronze Metallic a
(also termed "Special Dark Metallic Gray" or "Medium or Dark Gray Metallic")

d) Gray-painted 14 in. Magnum 500 wheels d

Which of the following features were standard on both 1967 Shelby GT 350s and GT 500s?
a) Roll bar
b) Shoulder harnesses
c) Mustang Deluxe interior
d) Fold down rear seat
e) All of the above a b c The Shelby taillights for 1967 are units from what other car model?
a) Cougar
b) Thunderbird a The standard 15 inch steel wheel for 1967 Shelbys features a Shelby logo wheel cover from what other car model?
a) Cougar
b) Thunderbird b The fiberglass Shelby hood for 1967 measures almost four inches longer than a stock Mustang hood.
True or False?
True The fiberglass Shelby hood for 1967 is secured by which of the following?
a) Hood pins
b) Standard hood latch
c) Both c Power disc brakes, power steering, and air conditioning were available for 1967 Shelby models.
True or False?
True In what year was a Shelby Convertible first offered to the buying public?
a) 1966
b) 1967
c) 1968
d) 1969 c At the beginning of production for which model year was Shelby production shifted from Shelby American's shop near the Los Angeles International Airport to the A. O. Smith Company in Ionia, Michigan?
a) 1967
b) 1968
c) 1969 b In 1968 a number of Shelby GT 350 Fastbacks were provided to the Hertz Rent-A-Car Company. Did these cars feature any exterior modifications identifying them as Hertz cars?
Yes or No?
No The 1967 Shelby features an 8000 rpm tachometer, and a gauge cluster which includes oil pressure and an ammeter gauge. Where is the tachometer located, and where is the gauge cluster located?
a) Under center of the dash → Gauge cluster
b) In the dash → Tachometer Which of the following engine/ transmission combinations for 1968 were required to include anti-smog equipment?
a) Four-speed GT 350s with 302 4V engines
b) Automatic GT 350s with 302 4V engines
c) Four-speed GT 500s with 428ci engines
d) Automatic GT 500s with 428ci engines
e) All of the above a c d
(b simpler crankcase ventilation system used)

Which model year Shelby has a Ford warranty/data plate riveted adjacent to the driver's door latch?
a) 1965
b) 1966
c) 1967
d) 1968 d How many 1968 GT 500KR Convertibles were produced?
a) 298
b) 318
c) 330 b 1968 Shelby Convertible Integral Overhead Safety Bars featured D-rings for surfboard attachment.
True or False?
True 1968 Shelby GT 500s were fitted with which of the following?
a) One four-barrel 715 cfm Holley carburetor
b) Twin Holley 650 cfm carburetors a
(b 1967 GT 500)

The 1969 Shelby SportsRoof is based on which of the following Mustang models?
a) Mach I
b) SportsRoof
c) Boss 302 a Which of the following wheels are available choices for the 1969 Shelby models?
a) 15 inch ten-spoke cast aluminum units
b) Five-spoke chrome steel rim with aluminum center Cobra logo cap
c) Both b 1969 Shelby models feature reflective full-length mid-bodyside tape stripes in which of the following colors?
a) Red In what year was the 306 hp 289 Hi-Po engine replaced by the four barrel 302 cubic inch engine rated at 250 hp?
a) 1967
b) 1968
c) 1969 b 1968 Shelby models feature which of the following?
a) Klik pin hood fasteners
b) Dzus twist-type hood locks b
(a 1967 Shelby models)

Match the following two choices to the correct model year.
a) Grill mounted Marchal or Lucas fog lights spaced at corners → 1968 Shelby
b) Grill mounted high beams positioned together at center → 1967 Shelby Which of the following model year Shelbys have a "Shelby-only style" front bumper?
a) 1967
b) 1968
c) 1969
d) 1970 c d
(a & b featured Mustang bumpers)

In what model year was the Windsor block 351 4V introduced for the Shelby GT 350?
a) 1967
b) 1968
c) 1969 c At which of the following plants did base vehicle production for 1969 Shelby models take place?
a) Dearborn
b) Metuchen
c) San Jose a Which of the following Shelby models was recalled due to a fire hazard potential from ignition of fuel vapors collected above the vent-type gas filler cap?
a) 1969 GT 500
b) 1968 GT 500
c) 1967 GT 500 a What model year Shelby features a chrome-trimmed black expanded aluminum section inset vertically into the deck lid and rear-fender end caps?
a) 1967
b) 1968
c) 1969 c Match the following 1969 codes to their corresponding interior colors.
a) 3A → Black vinyl
b) 3W → White vinyl -continued

| | |
|---|---|
| b) Blue | c) 3D → Red vinyl |
| c) Gold | |
| d) White | |
| e) Black | |
| f) All of the above b c d e | |
| Which of the following model year Shelbys do not have C-pillar air scoops? | New "Grabber" colors in blue, orange, green, and yellow are offered on which of the following model year Shelbys? |
| a) 1967 | a) 1969 |
| b) 1968 | b) 1968 |
| c) 1969 | c) 1967 a |
| d) 1970 c d | |
| 1969 Shelby Convertible quarter-panel scoops are more oblong and are positioned lower than the SportsRoof models. True or False? | Consoles for 1969 and 1970 Shelbys were adapted from which of the following? |
| True | a) Mustang units |
| A wooden shift handle appears on 1969 Shelby GT 350 and GT 500 models. However, what appears on the handle of the Cobra Jet cars? | b) Mercury Cougar units b |
| A silver Cobra | |
| Rear window slats are an option for which model year Shelby? | |
| a) 1967 | |
| b) 1968 | |
| c) 1969 c | |
| 1970 Shelbys differed from the 1969 models only slightly. The 1970 models feature which of the following? | |
| a) Twin black hood stripes | |
| b) Updated VIN codes | |
| c) Front spoiler | |
| d) Updated emissions controls meeting 1970 standards | |
| e) All of the above e | |

The Vehicle History and Trivia Race Game contains a specified number "Free Spaces" designated as "W" shown as white spaces in the preferred embodiment of FIG. 1. The free spaces "W" may include one or more logos or directional arrows which must be followed by the moving player. When a moving player lands on a free space "W" on the board containing the designation "Logo" or any type of logo, such as the brand name of an automobile, automotive service center, oil change facility, muffler shop, or brake shop, gas station, parts supply house, or dealership: the moving player is required to place their game piece 14–15 in an area on the board designated "LOGO", denoted as "L", which is located in the center of the board in the preferred embodiment of the "M" game board 10 has shown in FIG. 1. The moving player will remain on this space until their next turn. The player positioned in the LOGO space "L" must re-enter the designated course on a designated reenter space 34 which is indicated by an arrow 36 pointing to the reenter space 34 on the board 10. The arrow 36 does not count as a space for purposes of computing miles (kilometers). The mileage (kilometer) count begins with the reenter space 34. It is contemplated that an extra turn may be awarded upon reentry onto a selected logo on the course. For instance, an oil change service center having a particular brand name, such as displayed by the sponsor or promoter of the game, may be inserted in the logo space, and a player landing in that particular logo space would be rewarded with an extra turn to enter the reenter space 36.

The Vehicle History and Trivia Race Game contains at least one Detour Arrow 38. Upon landing on a Detour arrow 38, the moving player must move their playing piece in the direction of the arrow and travel toward a Dead End space 40 of the designated course. Upon reaching the Dead End space 40, the moving player stops or passes the dead end space reversing the direction of their replica 20 to travel back toward the Detour Arrow 38. The player takes turns rolling the die until the player travels safely beyond the detour arrow 38.

The Vehicle History and Trivia Race Game contains at least one Express Arrow 42 space. Upon landing on the express arrow space 42, the player must move their replica 20 in the direction of the arrow and travel the expressway course 44 which defines the top street on the board 10 denoted by the printed "EXPRESS" marking. If a player rolls a number which requires that the game piece advance past the express arrow space 42, they must move their playing piece turning to the right and travel down toward the longer portion of the course defining a "V" 46 course on the board 10. The expressway 44 can only be taken if the moving player lands directly on the express arrow space 42.

The Vehicle History and Trivia Race Game contains at least one red space denoted as "R". When a player lands on this unfortunate "R" space, titled "Vehicle Stolen" they are out of the game.

In order to win the game, the player must roll the die 22 and obtain the exact number of spaces designated as mile(s) or (kilometer(s) needed to land the replica 20 in position on the "END POINT" space. If the player rolls the die and obtains a number representing mile(s) or kilometer(s) greater than necessary to position the replica 20 on the END POINT space, the moving player remains in the pre-roll "present" position until the player's next turn when the sequence is repeated.

The foregoing detailed description is given primarily for clearness of understanding and no unnecessary limitations are to be understood therefrom, for modifications will become obvious to those skilled in the art based upon more recent disclosures and may be made without departing from the spirit of the invention and scope of the appended claims.

I claim:

1. A vehicle history and trivia game, comprising:

a) a game board having a course layout which includes a symbol selected from the group consisting of a name, letter, or acronym of a particular vehicle;

b) a set of draw cards;

c) a set of trivia cards;

d) a set of playing pieces depicting vehicles having specifications and features described by said trivia cards; and e) means for advancing said playing pieces along said course according to chance.

2. The vehicle history and trivia game of claim 1, wherein said set of playing pieces depicting vehicles are selected from the group consisting of automobiles, aircraft, tanks, trains, ships, trucks, and motorcycles.

3. The vehicle history and trivia game of claim 2, wherein said set of playing pieces depicting vehicles are replica models of existing vehicles and have no moving parts.

4. The vehicle history and trivia game of claim 3, wherein said replica models are selected from the brand name group consisting of FORD MUSTANG®, CHEVROLET CORVETTE®, DODGE CHARGER®, and HARLEY DAVIDSON®.

5. The vehicle history and trivia game of claim 2, wherein said set of playing pieces depicting vehicles are movable toy replica models of existing vehicles.

6. The vehicle history and trivia game of claim 5, wherein said movable replica models are selected from the brand name group consisting of FORD MUSTANG®, CHEVRO- LET CORVETTE®, DODGE CHARGER®, and HARLEY DAVIDSON®.

7. The vehicle history and trivia game of claim 2, wherein said set of playing pieces depicting vehicles are replica models of manufacturer's new models.

8. The vehicle history and trivia game of claim 1, wherein said trivia cards define questions and answers regarding historical data or specifications for particular vehicles.

9. The vehicle history and trivia game of claim 1, wherein said game pieces represent different models of the same brand of vehicle.

10. The vehicle history and trivia game of claim 1, wherein said draw cards define the expense of owning a vehicle and the repairs and costs associated therewith.

11. The vehicle history and trivia game of claim 1, wherein each space represents a unit of measure defining miles or kilometers.

12. The vehicle history and trivia game of claim 11, wherein a player must roll the exact number of miles needed to land on the endpoint space.

13. The vehicle history and trivia game of claim 1, wherein a player is given a predetermined amount of cash or credit to use for vehicle costs at the beginning of the game.

14. The vehicle history and trivia game of claim 13, wherein when a player acquires a running total of less than ZERO, a player is disqualified from playing and is out of the game.

15. The vehicle history and trivia game of claim 1, wherein said course layout includes spaces color coordinated with said draw cards and said trivia cards.

16. The vehicle history and trivia game of claim 1, wherein said set of draw cards is selected from the group consisting of repair cards including costs thereof, coupon cards for offsetting repair costs, free oil change cards, directional cards, lose a turn cards, and special instruction cards.

17. The vehicle history and trivia game of claim 1, wherein said symbol is the letter M.

18. The vehicle history and trivia game of claim 1, wherein said course layout includes a selected number of free spaces including a logo.

19. The vehicle history and trivia game of claim 18, wherein said logo is selected from the group consisting of a brand name of an automobile, automotive service center, oil change facility, muffler shop, brake shop, gas station, parts supply house, and dealership.

20. The vehicle history and trivia game of claim 1, wherein said course layout includes at least one Detour Arrow, at least one Express Arrow, and at least one Vehicle Stolen space.

* * * * *